US005927363A

United States Patent [19]

Olsen

[11] Patent Number: 5,927,363

[45] Date of Patent: Jul. 27, 1999

[54] PREFABRICATED COLLAPSIBLE AWNING FRAME SYSTEM

[76] Inventor: Todd C. Olsen, 839 Beech Ave., Findlay, Ohio 45840

[21] Appl. No.: 08/977,427

[22] Filed: Nov. 12, 1997

[51] Int. Cl.[6] ..... E04F 10/00

[52] U.S. Cl. ..... 160/83.1; 160/45; 160/377; 160/DIG. 5; 403/183; 403/217; 403/326; 135/116

[58] Field of Search ..... 160/83.1, 47, 45, 160/76, 377, DIG. 5; 403/326, 328, 169, 170, 217, 218, 316, 319; 248/273, 223.4, 345; 135/1, 116, 119

[56] References Cited

U.S. PATENT DOCUMENTS

| | | | |
|---|---|---|---|
| 977,565 | 12/1910 | Smith | 160/83.1 X |
| 1,618,184 | 2/1927 | Gist | 160/83.1 X |
| 1,844,410 | 2/1932 | Schalk | 160/83.1 |
| 2,768,823 | 10/1956 | Lindars | 265/56 |
| 3,114,376 | 12/1963 | Rexroat et al. | 135/1 |
| 3,424,178 | 1/1969 | Yazaki | 135/1 |
| 3,472,539 | 10/1969 | Fenwick | 403/328 X |
| 4,100,703 | 7/1978 | Sickler | 52/16 |
| 4,498,800 | 2/1985 | Sielaff | 403/217 X |
| 4,536,904 | 8/1985 | Whitehead | 403/316 X |
| 4,592,671 | 6/1986 | Daum | 403/217 X |
| 4,641,805 | 2/1987 | Martensson, IV | 248/273 |
| 4,692,847 | 9/1987 | Gandy | 362/152 |
| 4,793,286 | 12/1988 | Buxton | 135/116 X |
| 4,945,624 | 8/1990 | Toti | 29/453 |
| 5,083,331 | 1/1992 | Schnelle et al. | 403/327 X |
| 5,143,476 | 9/1992 | Pruis | 403/328 |
| 5,328,286 | 7/1994 | Lee | 403/170 X |
| 5,590,974 | 1/1997 | Yang | 403/327 |

OTHER PUBLICATIONS

Valco Snap Buttons Fasteners for Telescoping Tubing, Valco/Valley Tool & Die, Inc., glossary of terms, p. 1.

*Primary Examiner*—Daniel P. Stodola
*Assistant Examiner*—Bruce A. Lev
*Attorney, Agent, or Firm*—MacMillan, Sobanski & Todd, LLC

[57] ABSTRACT

A prefabricated collapsible awning frame system and method of forming the same. The awning frame system comprises a bracket assembly having a mounting plate that can be fixedly attached to a structure and a support member removably attached to the mounting plate. The frame system also includes at least one arm bar removably attached to the support member. A snap button is disposed with the support member and arm bar. The frame system may be assembled on the ground and the assembled frame system may be raised and removably attached to the mounting plate. To removably attach the support member and arm bar, the button head of the snap button is depressed and the support member or arm bar is slid onto the mounting plate or support member until the button head is aligned with the snap button opening. The support member and mounting plate may then be easily removed by depressing the button head and sliding the support member or arm bar using a reverse procedure. The awning frame system may be provided in a variety of different design configurations.

19 Claims, 17 Drawing Sheets

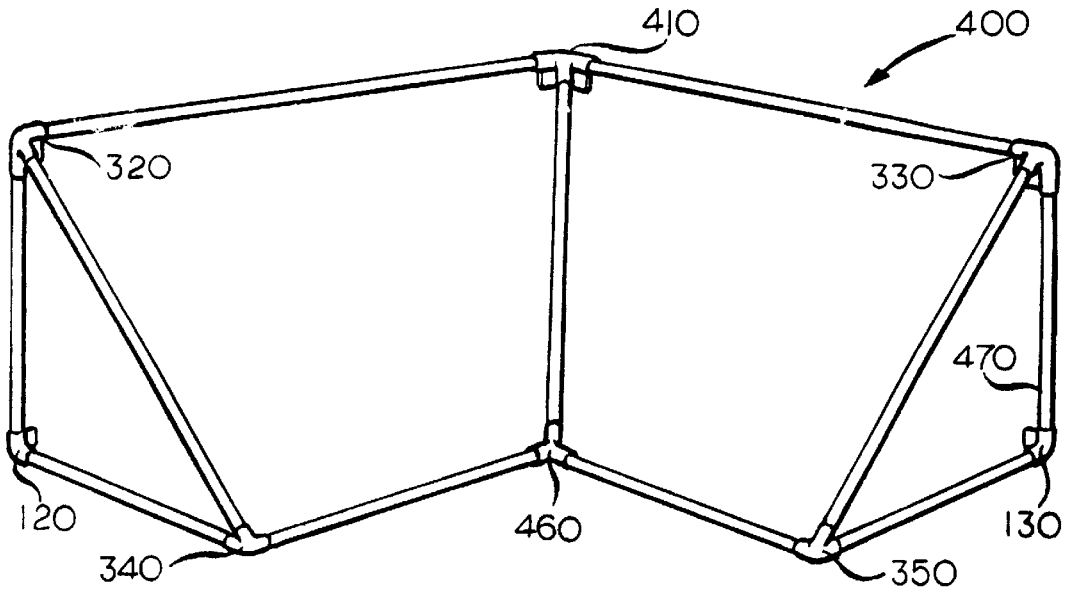
FIG. 4
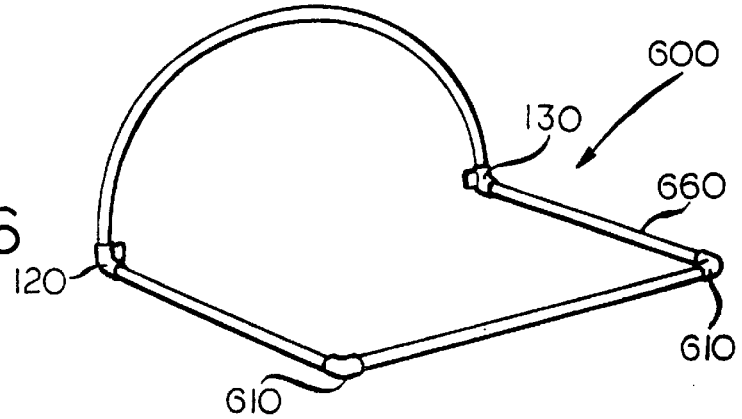
FIG. 6
FIG. 5
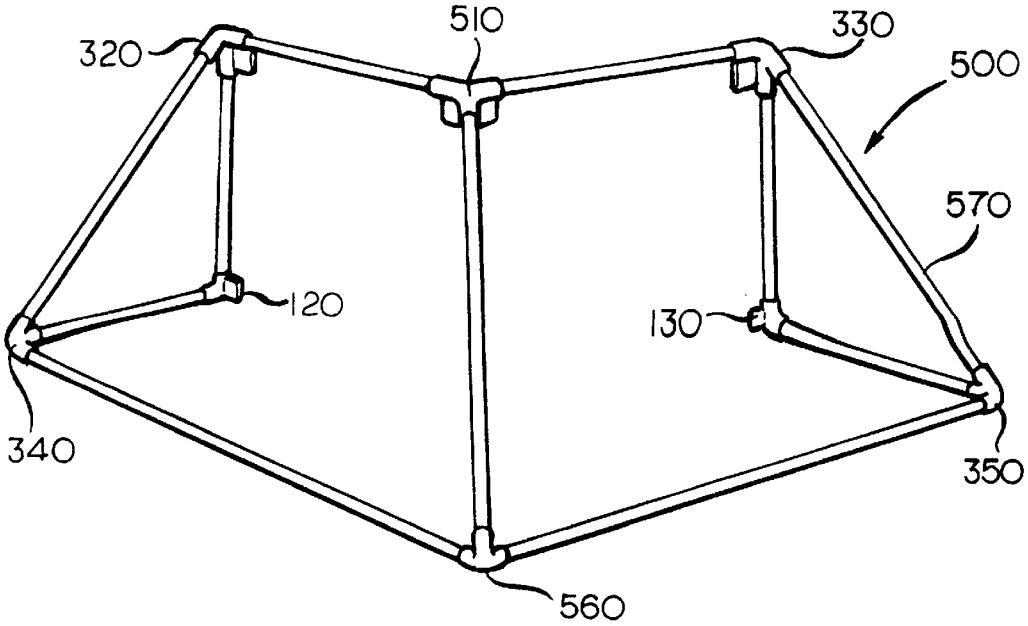

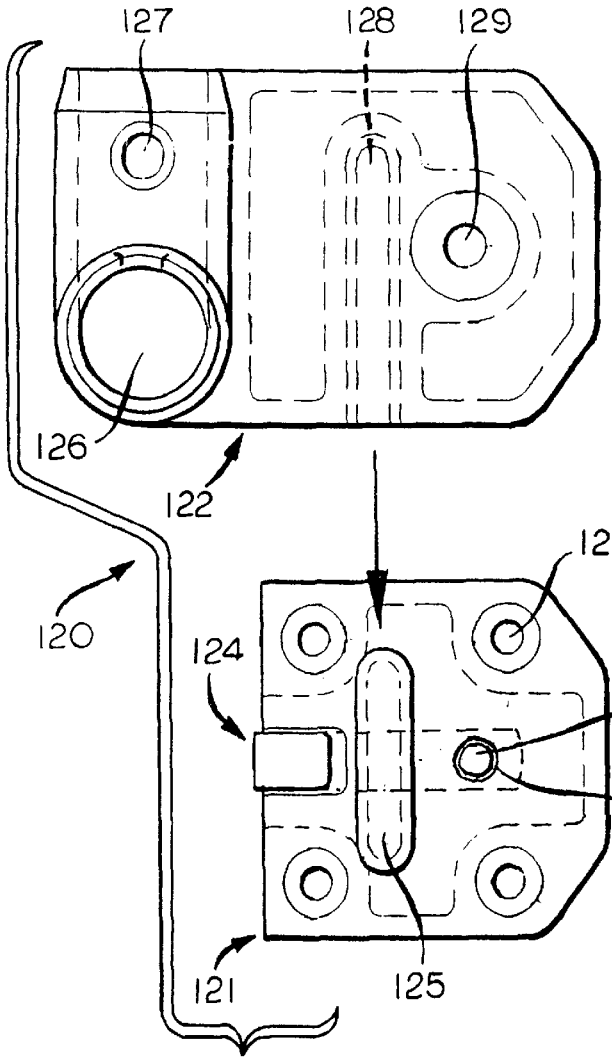
FIG. 12
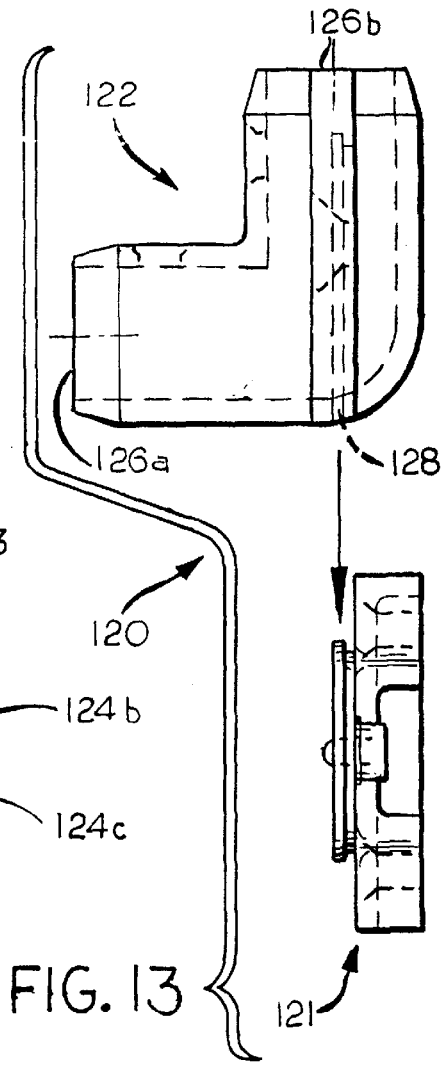
FIG. 13
FIG. 14
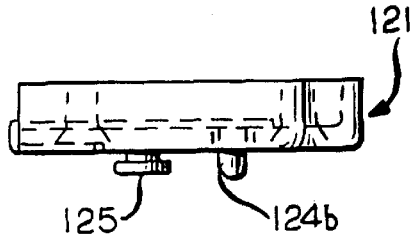
FIG. 15
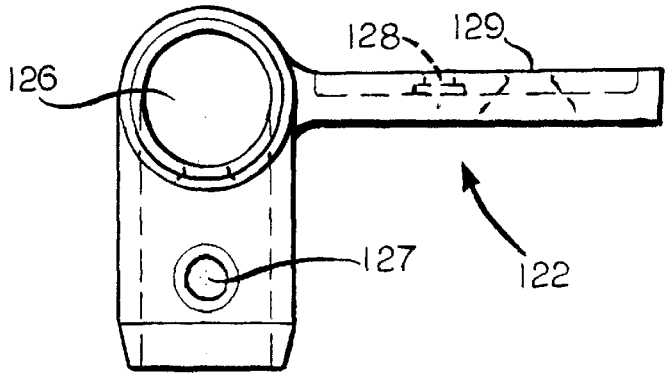

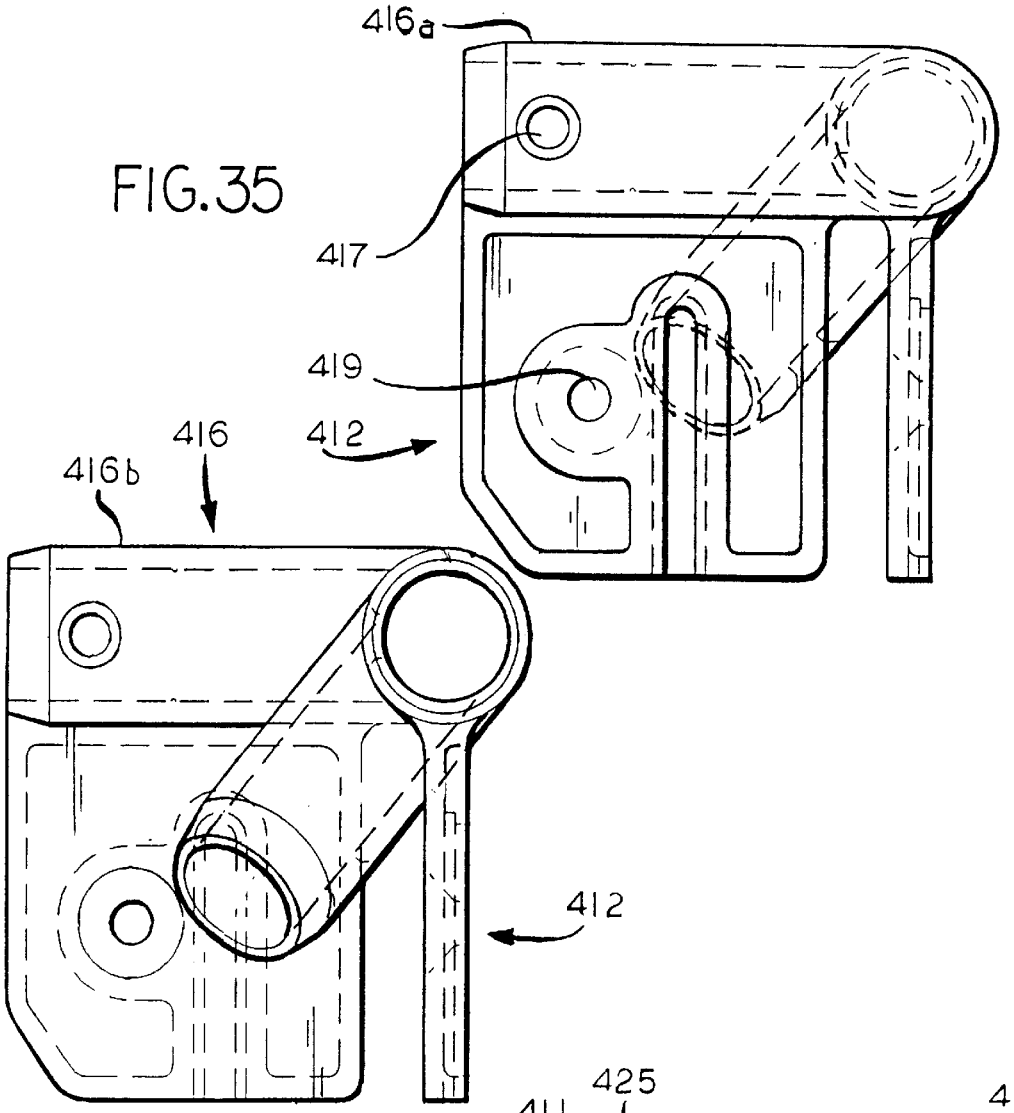
FIG. 35
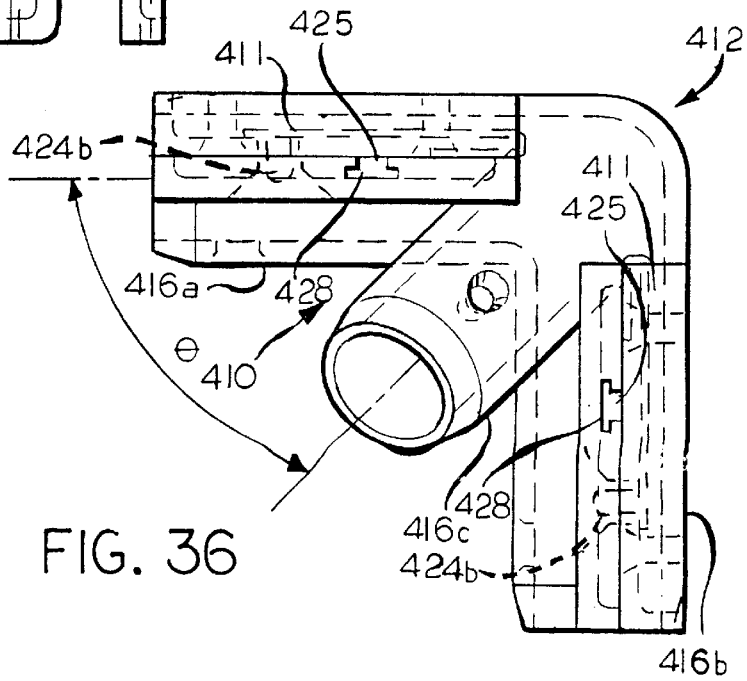
FIG. 34
FIG. 36

PREFABRICATED COLLAPSIBLE AWNING FRAME SYSTEM

BACKGROUND OF THE INVENTION

1. Field of the Invention

The invention relates in general to an awning system, and in particular to prefabricated awning system having separate components that snap into place for easy assembly, installation and removal.

2. Related Art

Typically, awning frames are rigid structures formed by connecting structural members together using any one of several conventional methods.

The most popular method of connecting the awning frame together is by direct welding the frame members together. A direct-welded frame is aesthetically pleasing because of the lack of bulges at the connections. If welded properly, the frame has the potential to develop the full bending resistance of the members at the joints, thus creating full frame behavior and generally taking better advantage of the capabilities of the members.

Another method of joining together the frame members is by using threaded fittings. The advantages of using such a method is that the materials are readily available and usually inexpensive and that the threaded pipe connections are normally strong connections.

Yet another method used in the industry to assemble frames involves the use of slip fittings. These are similar to threaded fittings, but, in this case, the pipe or tube slides into the open end of the fitting and is then held in position by tightening a set screw. This method has certain advantages over the threaded fitting method, such as, easy assembly and take down, easy adjustment of rafter spacing and minor on-site adjustments of frame members.

Traditionally, awnings are secured to a structure by the use of "S" hooks. Once the "S" hooks are installed to the structure, they require either a screw of set of screws to be inserted through the hooks and into the frame of the awning using tools. These steps must be repeated each time the awning is either installed or removed from the structure.

In addition, traditionally fabric is secured to the frame of an awning by either tying the fabric cover containing hundreds of eyelets using a rope or by stapling the fabric to special tubular frames and covering these with either a PVC or nylon cover. Both methods are very complex requiring specialized equipment. These highly specialized covering systems have been engineered to accommodate the rigid frame structures which are not receptive to being disassembled to receive slip-on fabric covers. In the case of welded frames, it is impossible and in the case of threaded or slip fittings, generally the awning frame remains attached to the structure while the laborious process of removing the cover takes place.

In light of the above, there is a need for an awning frame structure to be collapsible for easy shipment to the building site and to be prefabricated in a ready to assemble form without the need for tools.

SUMMARY OF THE INVENTION

To solve this problem, it is an object of the invention to provide an awning frame system that can be easily assembled and disassembled without the need for tools.

It is another object of the invention to provide an awning frame system that can be assembled on the ground, raised and securely locked in place and that can be released from its mounting position without the need for tools.

It is yet another object of the invention to provide a cost-effective awning frame system made of lightweight, durable material.

It is still another object of the invention to provide an awning frame system that can have any width, height or projection for accommodating any awning design.

It is yet still another object of the invention to provide an awning frame system that enables the removal or releasing of the fabric cover without the use of tools or specialized equipment.

To achieve these and other objects, the invention provides a prefabricated, collapsible awning frame system comprising at least a corner bracket assembly on each side of the awning frame system having a mounting plate for mounting to a physical structure and a support member capable of being removably attached to the mounting plate. The support member has at least one coupling part with a snap button opening. The awning frame system may be assembled by slidably entering at least one arm bar into the support member until the snap button disposed in the at least one arm bar is received in a snap button opening of the support member.

In the first preferred embodiment, the awning frame system may form a classic dome-shaped awning frame system. The awning frame system comprises a center bracket assembly having a plurality of female coupling parts. The center bracket assembly has a mounting plate for mounting to a structure and a support member that can be removably attached to the mounting plate. The awning frame system also has a left and right corner bracket assembly having a mounting plate for mounting to the structure and a support member removably attached to the mounting plate.

In the second and third preferred embodiments, the awning frame system may form a convex-shaped and concave-shape awning frame system, respectively. The awning frame system comprises a center bracket assembly, an upper left corner bracket assembly, an upper right corner bracket assembly, a lower left corner bracket assembly, a lower right corner bracket assembly, at least one T-shaped fitting, a left 3-way corner fitting, a right 3-way corner fitting, and a plurality of arm bars.

In the fourth and fifth preferred embodiments, the awning frame system may form an inside and outside mitered corner awning design, respectively. The awning frame system comprises a center inside/outside mitered corner bracket assembly, an upper left corner bracket assembly, an upper right corner bracket assembly, a lower left corner bracket assembly, a lower right corner bracket assembly, an center inside/outside mitered corner fitting, a left 3-way corner fitting, a right 3-way corner fitting, and a plurality of arm bars.

In the sixth preferred embodiment, the awning frame system may form a circle awning design. The awning frame system comprises a left corner bracket assembly, a right corner bracket assembly, a pair of 2-way corner fittings and a plurality of arm bars.

In all the preferred embodiments, the awning frame system has a plurality of arm bar members that may be connected to one of the center bracket assembly, corner bracket assemblies and fittings by slidingly entering the arm bar into the bracket assemblies and fittings until a snap button protrudes from a snap button opening on the bracket assemblies and fittings. The fully assembled frame system may then be raised and secured to the structure by sliding the support members over and around projections on the mounting plates until a snap button disposed in the mounting plate protrudes from a snap button opening on the support member.

It should be appreciated that the invention is not limited by the designs of the preferred embodiments and that the invention may form other well-known designs, such as, an entrance canopy design, a dome-front canopy design, a carriage-dome canopy design, an arabian spear design and a square design.

These and other aspects and advantages of the invention are described or apparent from the following detailed description of the preferred embodiments and appended drawings wherein like reference numbers refer to the same element, feature or component.

BRIEF DESCRIPTION OF THE DRAWINGS

The preferred embodiments are described with reference to the drawings in which:

FIG. 4 shows a side perspective view of an inside mitred corner awning design using the prefabricated collapsible awning frame system according to a fourth preferred embodiment of the invention;

FIG. 5 shows a side perspective view of an outside mitred corner awning design using the prefabricated collapsible awning frame system according to a fifth preferred embodiment of the invention;

FIG. 6 shows a side perspective view of a circle awning design using the prefabricated collapsible awning frame system according to a sixth preferred embodiment of the invention;

FIG. 12 shows a front view of the left corner bracket assembly of the invention;

FIG. 13 shows a side view of the left corner bracket assembly of the invention;

FIG. 14 shows a top view of the mounting plate of the left corner bracket assembly of FIG. 11;

FIG. 15 shows a top view of the support member of the left corner bracket assembly of FIG. 11;

FIG. 34 shows a front view of the center inside mitered corner bracket assembly according to the fourth preferred embodiment of FIG. 4;

FIG. 35 shows a back view of the center inside mitered corner bracket assembly of FIG. 34;

FIG. 36 shows a bottom view of the center inside mitered corner bracket assembly of FIG. 34 when the support member is removably attached to the mounting plate;

DETAILED DESCRIPTION OF THE PREFERRED EMBODIMENTS

Figure 1:
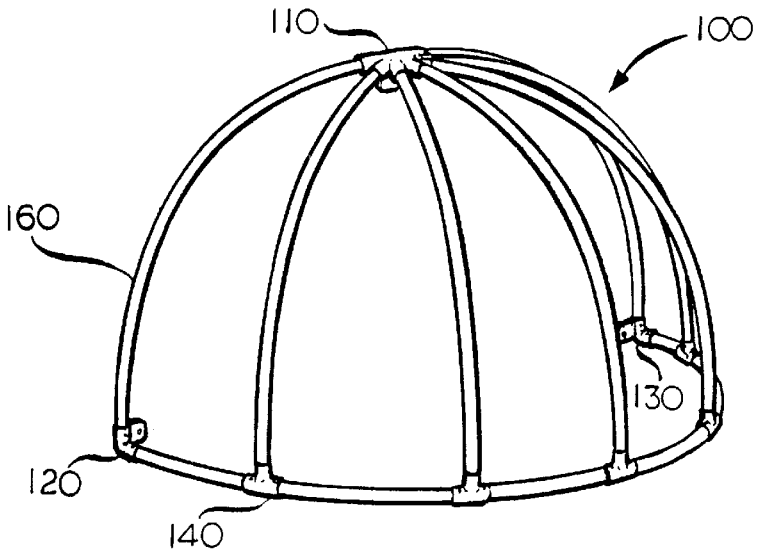
FIG. 1 shows a side perspective view of a classic dome awning design using the prefabricated collapsible awning frame system according to a preferred embodiment of the invention.

FIG. 1 shows a classic dome design of a prefabricated collapsible awning frame system 100 according to a first preferred embodiment of the invention. In general, the awning frame system 100 includes a center bracket assembly 110, a left corner bracket assembly 120, a right corner bracket assembly 130, a plurality of fittings 140 and a plurality of arm bars 160. The awning frame system 100 may be made of any suitable material, preferably a lightweight, sturdy material, such as polyvinyl chloride (PVC), acrylonitrile butadiene styrene (ABS), Nylon (polyamide), steel, stainless steel, aluminum and the like.

Referring now to FIGS. 7 through 10, the center bracket assembly 110 includes a mounting plate 111 and a support member 112. The mounting plate 111 includes a plurality of openings 113 for attaching the mounting plate 111 to a structure (not shown) using conventional fastening means, such as screws, bolts and the like. The mounting plate 111 also includes a snap button 114 of a type commercially available from Valley Tool & Die, Inc. of North Royalton, Ohio under the trademark VALCO®. Typically, the snap button 114 is made of high-tensile stainless steel and zinc plated for rust protection. The snap button 114 may be disposed within the mounting plate 111 such that an upward-turned lower portion 114*a* of the snap button 114 frictionally engages the mounting plate 111 to firmly hold the snap button 114 in place. In addition, the legs of the snap button 114 frictionally engage the inner walls of the mounting plate 111 due to the spring force of the snap button 114 when compressed and disposed within the mounting plate 111. Also, a projecting upper portion or button head 114*b* extends outwardly from or projects through an opening 114*c* in the mounting plate 111 due to the spring force of the snap button 114 when disposed and compressed in the mounting plate 111. It is envisioned that the button head 114*b* can be of any shape. For example, instead of a rounded head in the preferred embodiment, the button head 114*b* may have a sloped head, that is, having a downward angle such that the button head will be depressed by the support member 112, rather than the user, when installing the support member 112 to the mounting plate 111 as described below.

Figure 8:
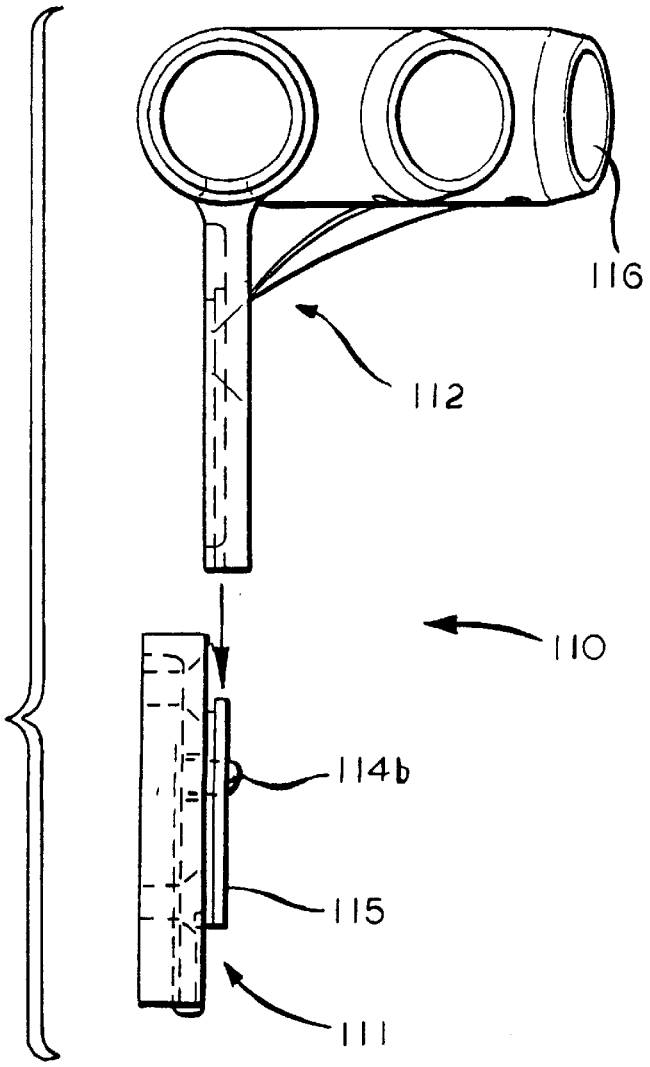
FIG. 8 shows a side view of the center bracket assembly of FIG. 7.

In addition, the mounting plate 111 also includes at least one projection 115, preferably a pair of projections 115, on the front surface of the mounting plate 111. As best seen in FIG. 8, each projection 115 extends outwardly a predetermined distance from the lower portion of the mounting plate 111. Each projection 115 has an outwardly projecting portion that forms a slot between the projection 115 and the lower portion of the mounting plate 111.

Figure 9:
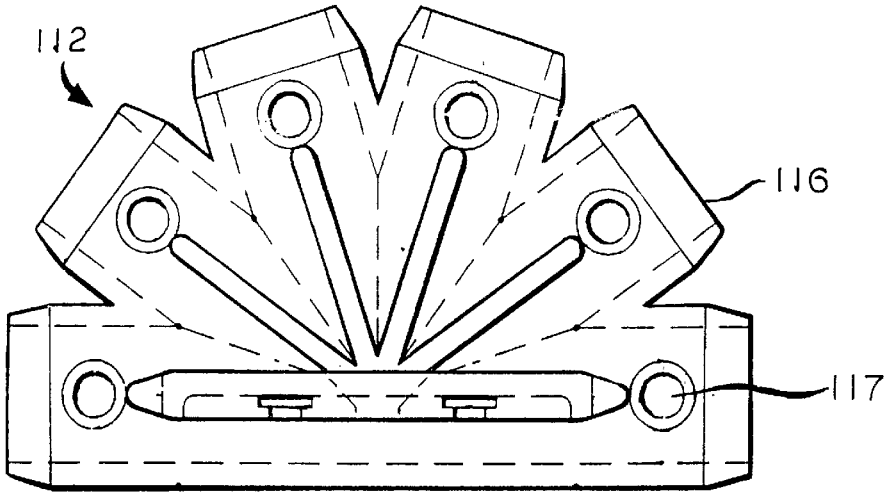
FIG. 9 shows a bottom view of the center bracket assembly of FIG. 7 when the support member is removably attached to the mounting plate.

In the first preferred embodiment of the invention, the support member 112 includes a plurality of female coupling parts 116 located on an upper portion of the support member 112. Preferably, each female coupling parts 116 is disposed at an angle of approximately 36 degrees with respect to each other. The end of each female coupling parts 116 have a substantially uniform inner diameter to form a port or opening for allowing arm bars 160 to slidingly enter into the female coupling part 116. Preferably, the outside of each female coupling parts 116 is tapered for aesthetic purposes. As best seen in FIG. 9, each female coupling parts 116 includes a snap button opening 117 to allow the snap button 161 of the arm bar 160 to protrude therethrough (as discussed below).

It should be appreciated that the invention is not limited to the number of female coupling parts 116 and that the invention can be practiced with any number of female coupling parts 116. It should be realized that the angle at which the female coupling parts 116 are disposed relative to each other may be expressed as:

$$180/(n-1)$$

where, n is the number of female coupling parts. Thus, for example, the invention may be practiced with five (5) female coupling parts disposed at an angle of approximately 180/(5−1)=45 degrees with respect to each other.

It should also be realized that the female coupling parts 116 may be at any angle with respect to the support member 112 to form any desired dome-shaped awning frame design. Thus, for example, the invention may be practiced with female coupling parts 116 having an angle of approximately 45 degrees with respect to the support member 112, instead of an angle of 90 degrees as shown in FIGS. 7 through 9.

Figure 7:
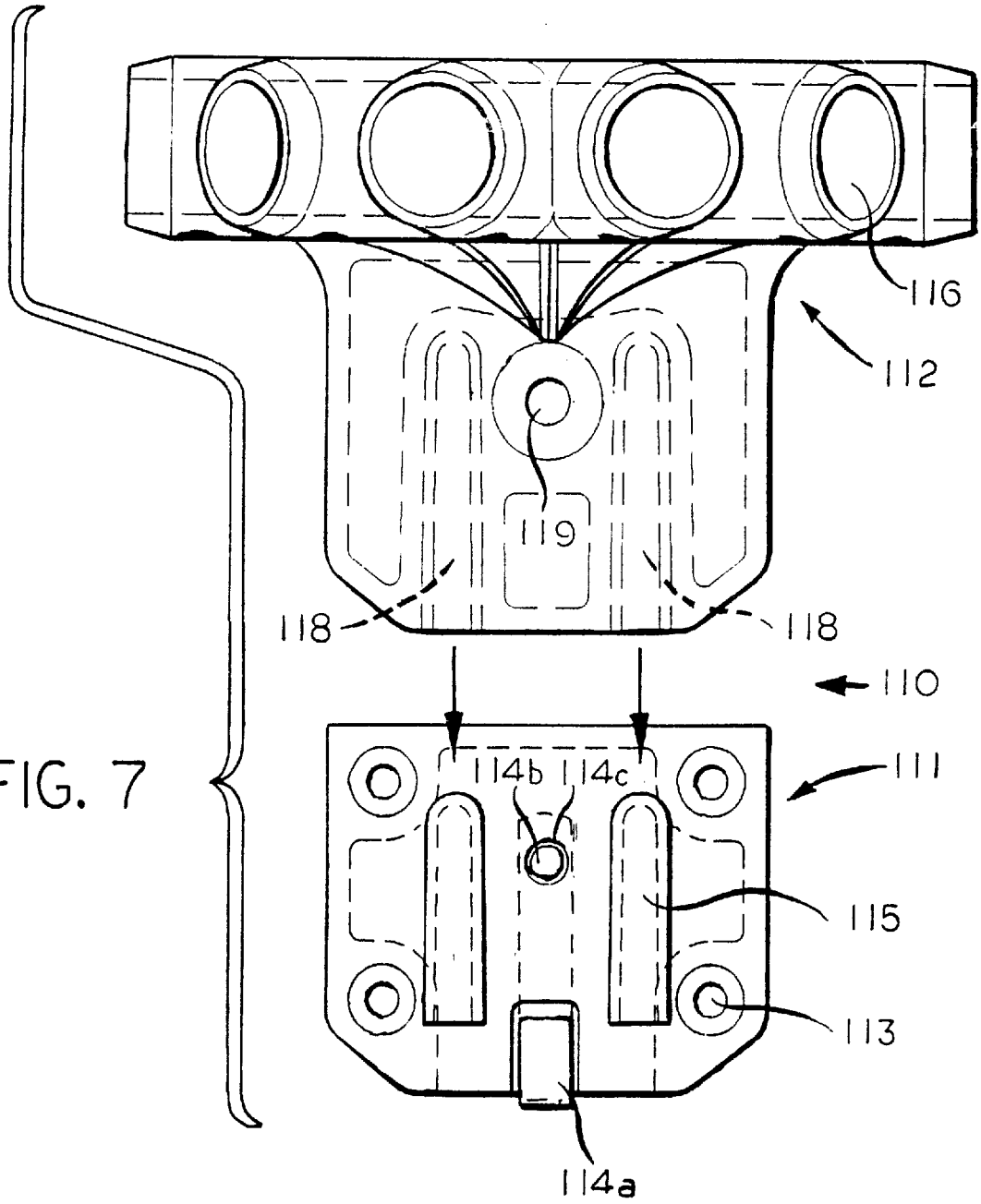
FIG. 7 shows a front view of the center bracket assembly according to the first preferred embodiment of FIG. 1.
Figure 10:
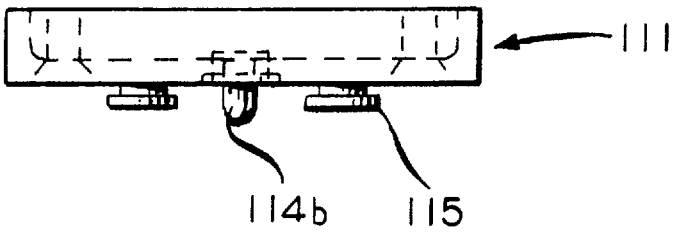
FIG. 10 shows a top view of the mounting plate of the center bracket assembly of FIG. 7.

Referring now to FIG. 7, the support member 112 also includes a projection slot 118 (dotted lines) for receiving each projection 115 of the mounting plate 111. The dimensions of the slot 118 is such that the projection 115 is capable of being received within the slot 118. The support member 112 is removably attached to the mounting plate 111 by aligning the slot 118 of the support member 112 with the projection 115 of the mounting plate 111 and sliding the support member 112 over the mounting plate 111 in a downward direction as indicated by the arrows shown in FIGS. 7 and 8.

The support member 112 also includes a snap button receiving opening 119 disposed at a predetermined location. The opening 119 is located such that the button head 114*b* of the snap button 114 is substantially aligned with the opening 119 of the support member 112 when the projection 115 of the mounting plate 111 is fully received within the slot 118 of the support member 112. When the support member 112 is completely slid onto the mounting plate 111, the button head 114*b* protrudes through the opening 114*c* to removably attach the support member 112 to the mounting plate 111 without the use of tools. The support member 112 may be easily removed from the mounting plate 111 by depressing the button head 114*b* while sliding the support member 112 in an upward direction, that is, in an opposite direction to that indicated by the arrows in FIGS. 7 and 8.

FIGS. 11 through 15 show the left corner bracket assembly 120 of the invention. Similar to the center bracket assembly 110, the left corner bracket assembly 120 includes a mounting plate 121 and a support member 122. The mounting plate 121 includes a plurality of openings 123, preferably 4 openings, for attaching the mounting plate 121 to a structure (not shown) using conventional fastening means, such as screws, bolts and the like. The mounting plate 121 also includes a snap button 124 of the type used in the center bracket assembly 110.

Similar to the snap button 114 of the center bracket assembly 110, the snap button 124 may be disposed within the mounting plate 121 such that an upward-turned lower portion 124*a* and the legs (dotted lines) of the snap button 124 frictionally engage the mounting plate 121 to firmly hold the snap button 124 in place. In addition, a projecting upper portion or button head 124*b* projects from an opening 124*c* in the mounting plate 121 due to the spring force of the snap button 124 when disposed in the mounting plate 121.

The mounting plate 121 also includes at least one projection 125 on the front surface of the mounting plate 121. As best seen in FIG. 14, the projection 125 is disposed a predetermined distance from the mounting plate 121.

The support member 122 includes a plurality of female coupling parts 126, preferably 2 coupling parts 126*a*, 126*b* disposed at an angle of approximately 90 degrees with respect to a longitudinal axis (dotted lines) passing through the center of each coupling part 126. Similar to the center bracket assembly 110, each female coupling part 126*a*, 126*b* is tapered on the end for aesthetic purposes and has a substantially uniform inner diameter to form a port or opening for allowing arm bars 160 to slidingly enter the female coupling parts 126*a*, 126*b*. As best seen in FIGS. 12 and 15, each female coupling part 126 includes a snap button opening 127 to enable the snap button 161 of the arm bar 160 to protrude therethrough.

It should be appreciated that the invention is not limited to the number of female coupling parts 126 for the left corner bracket assembly 120 and that the invention can be practiced with any number of female coupling parts 126. It should be also be appreciated that the female coupling parts 126 may be at any angle, such as 22.5, 45.0, 67.5 and the like, with respect to each other to form any desired shape of the awning design.

Referring now to FIG. 12, the support member 122 also includes a projection slot 128 (dotted lines) for receiving the projection 125 of the mounting plate 121. Similar to the center bracket assembly 110, the dimensions of the slot 128 is such that the projection 125 is capable of being received within the slot 128 when the support member 122 is slid onto the mounting plate 121 in a downward direction as indicated by the arrow shown in FIGS. 12 and 13.

Similar to the center bracket assembly 110, the support member 122 of the left corner bracket assembly 120 also includes a snap button receiving opening 129 disposed at a predetermined location. Similar to the center bracket assembly 110, the opening 129 is located such that the button head 124*b* of snap button 124 aligns with the opening 129 when the support member 122 is slid all the way onto the mounting plate 121. In this position, the button head 124*b* protrudes through the opening 124*c* to removably attach the support member 122 to the mounting plate 121 without the use of tools.

The support member 122 may be easily removed without the use of tools from the mounting plate 121 by depressing the button head 124*b* and sliding the support member 122 in an upward direction, that is, in an opposite direction to that indicated by the arrow in FIGS. 12 and 13.

It should be realized that the right corner bracket assembly 130 of the invention is identical to the left corner bracket assembly 120, but with mirror symmetry in the vertical direction. For brevity, the discussion relating to the right corner bracket assembly 130 is omitted.

Figure 16:
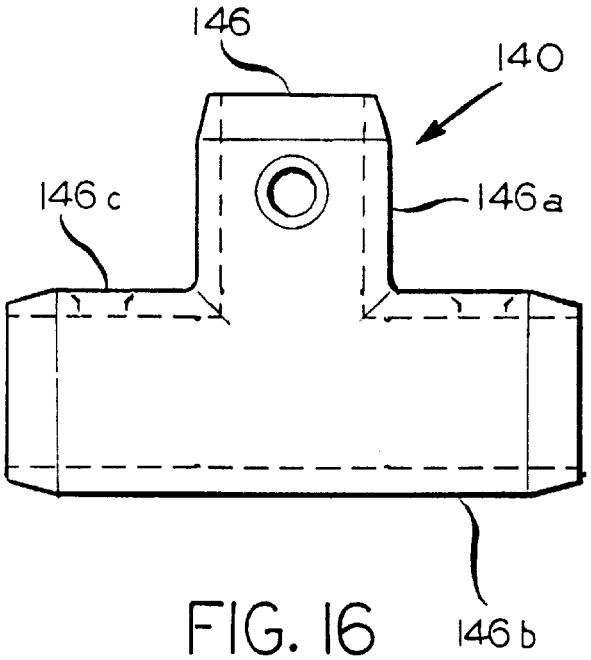
FIG. 16 shows a front view of the T-shaped fitting of the invention.
Figure 17:
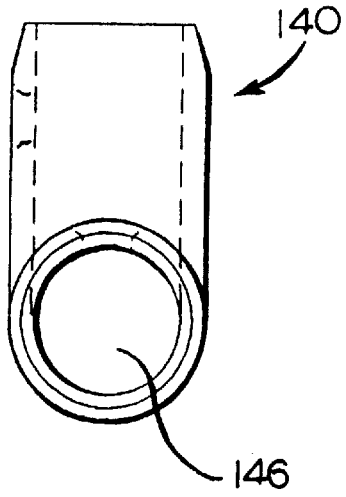
FIG. 17 shows a side view of the T-shaped fitting of FIG. 16.
Figure 18:
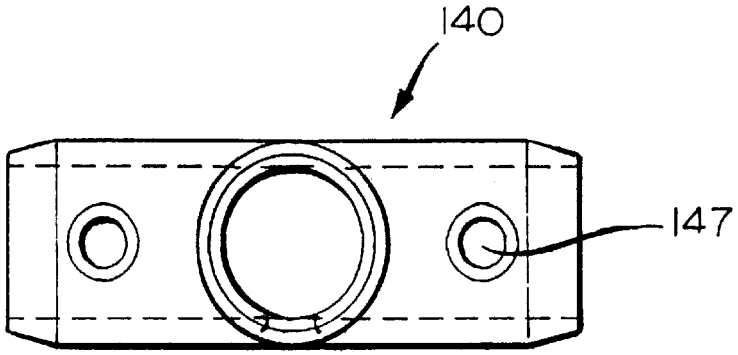
FIG. 18 shows a top view of the T-shaped fitting of FIG. 16.

FIGS. 16 through 18 show the fitting 140 of the invention. The fitting 140 includes a plurality of female coupling parts 146, preferably 3 female coupling parts, disposed at an angle of approximately 90 degrees with respect to a longitudinal axis (dotted lines) passing through the center of each female coupling part 146. As best seen in FIG. 16, one of the female coupling parts 146*a* is located approximately equidistant between the other two female coupling parts 146*b*, 146*c* to form a fitting 140 having a T-shaped cross-sectional shape. Similar to other female coupling parts, each female coupling part 146 are tapered on the end for aesthetic purposes and has a substantially uniform inner diameter to form a port or opening for allowing arm bars 160 to slidingly enter into the female coupling part 146. As best seen in FIG. 18, each female coupling part 146 includes a snap button opening 147 to allow the button head of snap button 161 of the arm bars 160 to protrude through the button opening 147 in a manner similar to the snap button 114 of the center bracket assembly 110.

It should be appreciated that the invention is not limited to the number or the angle of the female coupling parts and that the invention can be practiced with any number of female coupling parts having any angle with respect to each other.

Referring now to FIG. 1, the awning frame system 100 includes a plurality of arm bars 160. Each arm bar 160 is substantially circular in cross-sectional shape having a outside diameter (O.D.) slightly less than the inside diameter (I.D.) of the female coupling parts 116, 126, 146 so that the arm bar 160 can be slidably entered into the female coupling parts. It should be appreciated that the invention is not limited by the cross-sectional shape of the arm bars 160 and female coupling parts 116, 126, 146 and that the invention can be practiced with any cross-sectional shape, such as, square, rectangular, polygonal and the like.

Figure 11:
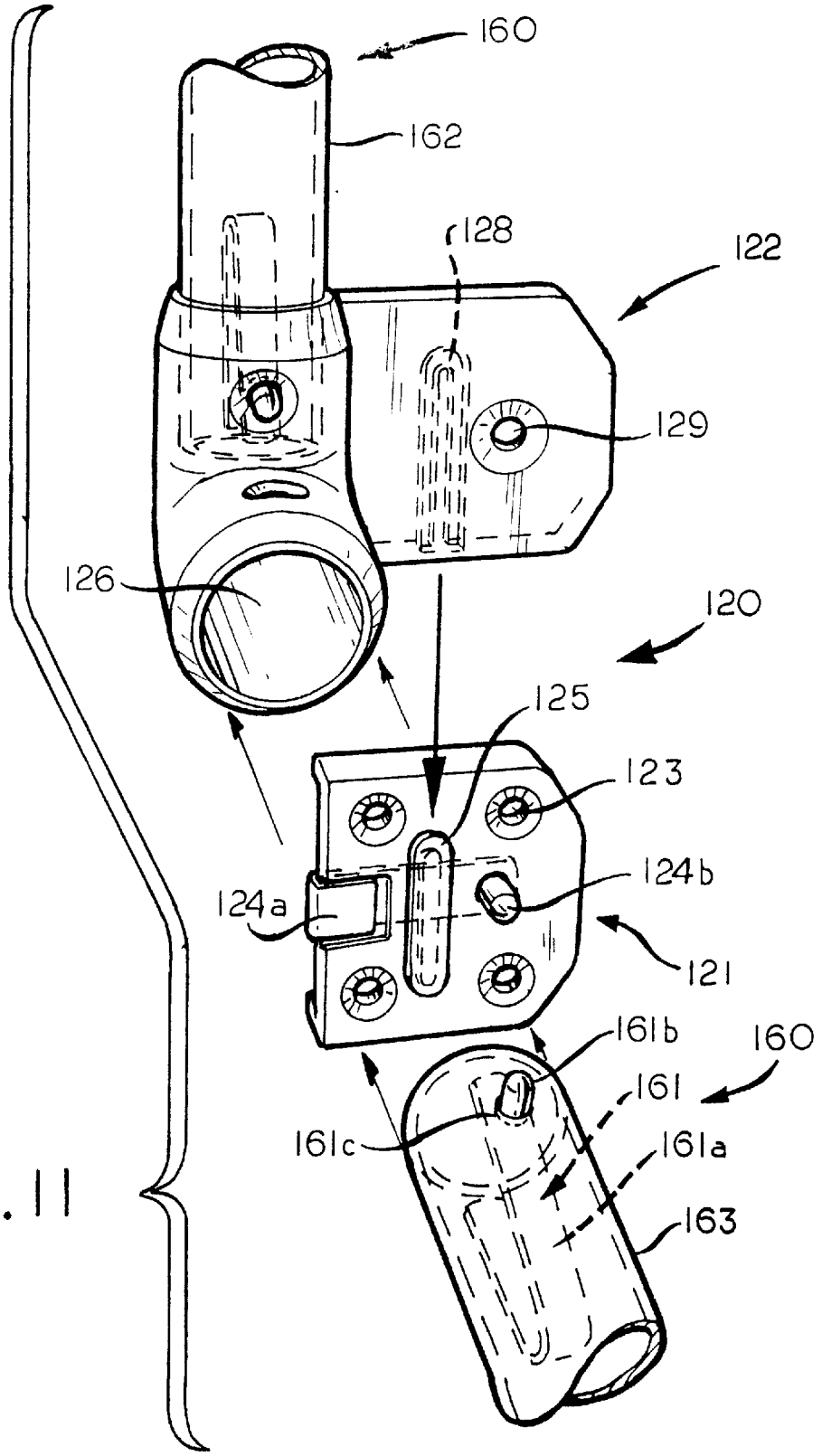
FIG. 11 shows a side perspective exploded view of the left corner bracket assembly of the invention.

As best seen in FIG. 11, each arm bar 160 includes a snap button 161 disposed within the arm bar 160 to form a male coupling part. Similar to snap button 114 of the center bracket assembly 110, the snap button 161 is disposed within each end of the arm bar 160 such that the legs 161*a* (dotted lines) of the snap button 161 frictionally engage the inside wall of the arm bar 160. The spring force of the snap button 161 causes an upper portion or button head 161*b* to protrude through an opening 161*c* in the arm bar 160 and firmly hold the snap button 161 in place.

The arm bar 160 may be removably attached to a female coupling part 116, 126, 146 by depressing the button head 161*b* while slidably entering the arm bar 160 into the female coupling part 116, 126, 146. The arm bar 160 may be slidably entered until the button head 161*b* is substantially aligned with the snap button opening 117, 127, 147. Once substantially aligned, the button head 161*b* projects from the female coupling part 116, 126, 146, thereby removably attaching the arm bar 160 to the female coupling part without the use of tools.

It should be realized that the length and curvature of the arm bars 160 may be any length depending on the awning frame design. For example, the dome-shaped awning frame system 100 may include a plurality of arcuate wall bars 162 and a plurality of bottom bars 163. As best seen in FIG. 1, to form the one-quarter sphere of the classic dome awning frame system 100, the chord length of each wall bar 162 and each bottom bar 163 is substantially identical.

Figure 2:
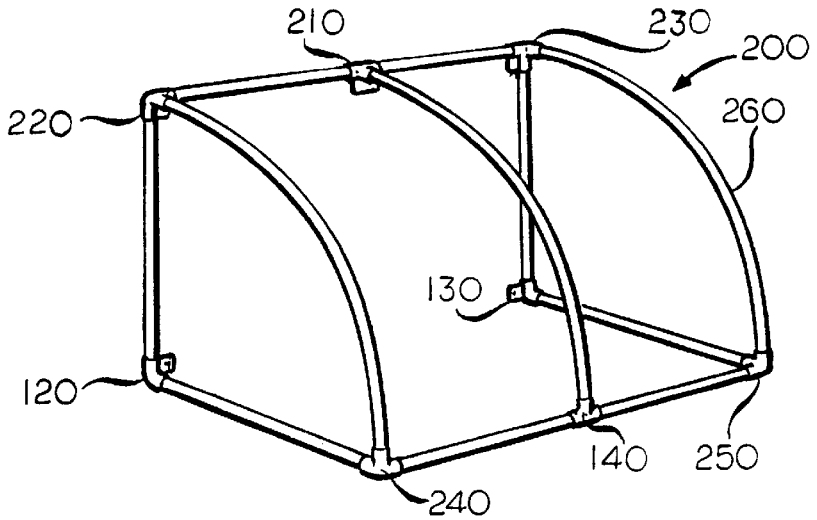
FIG. 2 shows a side perspective view of a convex awning design using the prefabricated collapsible awning frame system according to a second preferred embodiment of the invention.

FIG. 2 shows a convex awning design of the prefabricated collapsible awning frame system 200 according to a second preferred embodiment of the invention. In general, the awning frame system 200 includes a center bracket assembly 210, an upper left corner bracket assembly 220, an upper right corner bracket assembly 230, a lower left corner bracket assembly 120, a lower right corner bracket assembly 130, at least one T-shaped fitting 140, a left 3-way corner fitting 240, a right 3-way corner fitting 250, and a plurality of arm bars 260. Similar to the awning frame system 100, the awning frame system 200 may be made of any suitable material, preferably a lightweight, sturdy material, such as polyvinyl chloride (PVC), acrylonitrile butadiene styrene (ABS), Nylon (polyamide), steel, stainless steel, aluminum and the like. It should be noted that the center bracket assembly 210 may not be necessary if the width of the awning frame system 200 can be supported solely by the left and right corner bracket assemblies. For example, with an awning frame system of only 24 inches, it may not be necessary to have a center bracket assembly, whereas an awning frame system of 48 inches may require a center bracket assembly.

Figure 19:
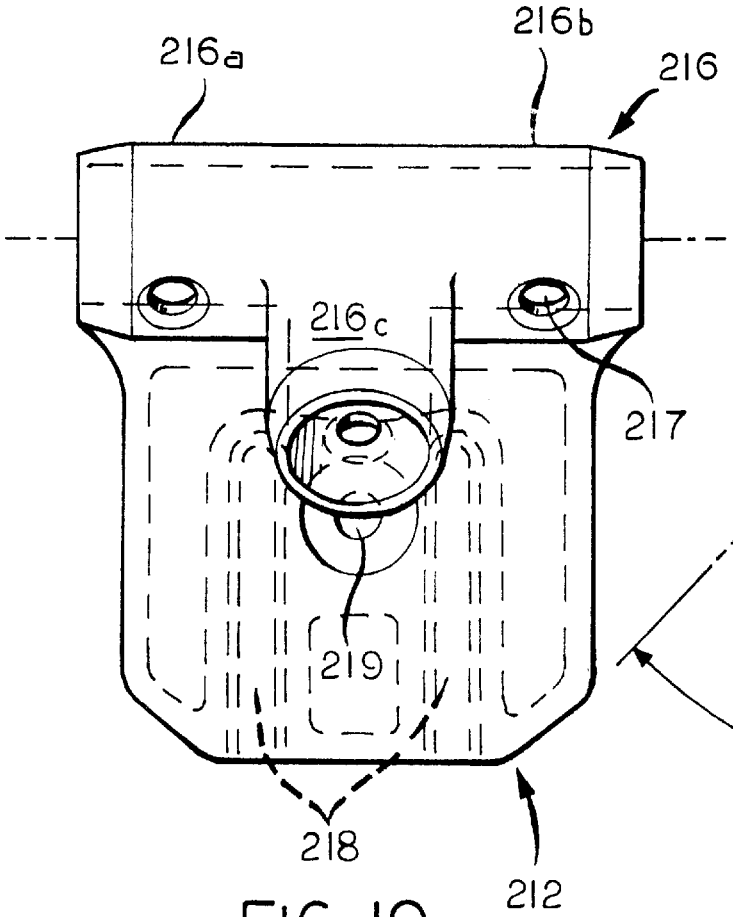
FIG. 19 shows a front view of the center bracket assembly according to the second preferred embodiment of FIG. 2.
Figure 20:
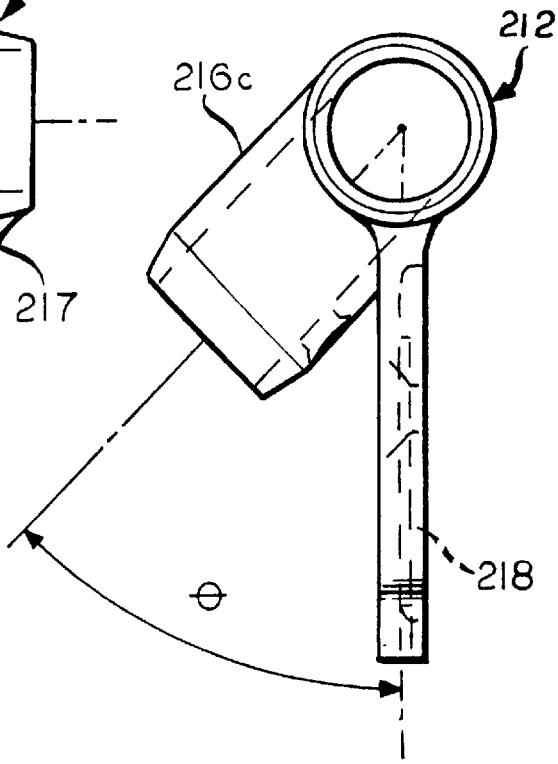
FIG. 20 shows a side view of the center bracket assembly of FIG. 19.
Figure 21:
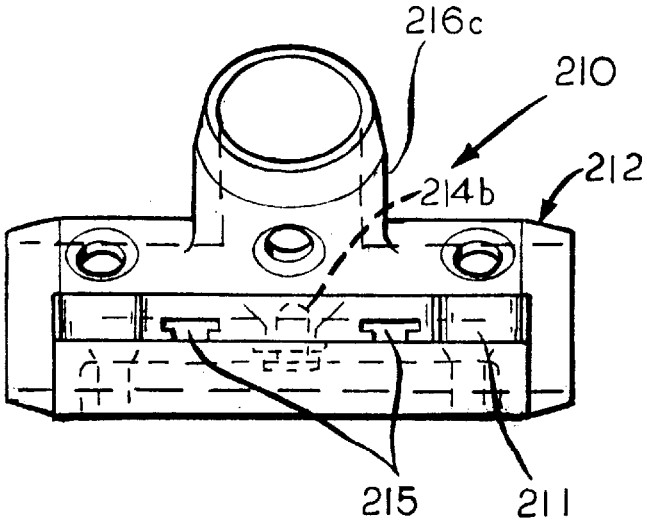
FIG. 21 shows a bottom view of the center bracket assembly of FIG. 19 when the support member is removably attached to the mounting plate.

Referring now to FIGS. 19 through 21, the center bracket assembly 210 includes a mounting plate 211 and a support member 212. The operation of the mounting plate 211 is substantially similar to the mounting plate 111 of the first preferred embodiment of the invention. The mounting plate 211 includes a plurality of openings (dotted lines) for attaching the mounting plate 211 to a structure, a pair of projections 215 on the front surface and a snap button opening (not shown) for allowing snap button head 214*b* to project therethrough. For brevity, the discussion of the operation of the mounting plate 211 will be omitted herein.

In a manner similar to the first preferred embodiment, the support member 212 includes a plurality of female coupling parts 216*a*, 216*b*, 216*c*, preferably 3 coupling parts, located at an upper portion of the support member 212. It should be appreciated that the invention is not limited to the number of female coupling parts 216 and that the invention can be practiced with any number of female coupling parts. Similar to the first preferred embodiment, each female coupling part 216 are tapered on the end for aesthetic purposes and have a substantially uniform inner diameter to form a port or opening for allowing arm bars 260 to slidingly enter each female coupling part 216. Also, each female coupling part includes a snap button opening 217.

As best seen in FIG. 19, one female coupling part 216*c* is disposed approximately equidistant along the longitudinal axis between the other two female coupling parts 216*a*, 216*b* to form a T-shaped upper portion of the support member 212. In addition, the third female coupling part 216*c* extends outwardly at an angle of 90 degrees with respect to the longitudinal axis (dotted line) passing through the other two female coupling parts 216*a*, 216*b*.

As best seen in FIG. 20, the third coupling 216*c* is at an angle, θ, with respect to the lower portion of the support member 212, preferably at an angle of approximately 90 degrees. However, it should be appreciated that the angle, θ, may be any angle, such as, 67.5, 45.0, 22.5 degrees and the like, to form any desired awning design. For example, FIG. 20 shows the third female coupling portion 216*c* to be at an angle of approximately 45 degrees with respect to the lower portion of the support member 212.

FIG. 21 shows the support member 212 that may be removably attached to the mounting plate 211 in a similar manner to the first preferred embodiment. This is accomplished by sliding the support member 212 onto the mounting plate 211 such that the projections 215 are received in the slot 218. The support member 212 is slidingly received until the snap button head 214*b* that is disposed within the mounting plate 211 aligns with the snap button opening 219 of the support member 212. The spring force of the snap button causes the snap button head 214*b* to protrude from the snap button opening 219, thereby removably attaching the support member 212 to the mounting plate 211.

Please note that the center bracket assembly 210 comprising the support member 212 and the mounting plate 211 provides additional support for the awning frame system 200. In instances where the additional support is needed, additional center bracket assemblies 210 may be used depending on the width of the convex awning design awning frame system 200.

Figure 22:
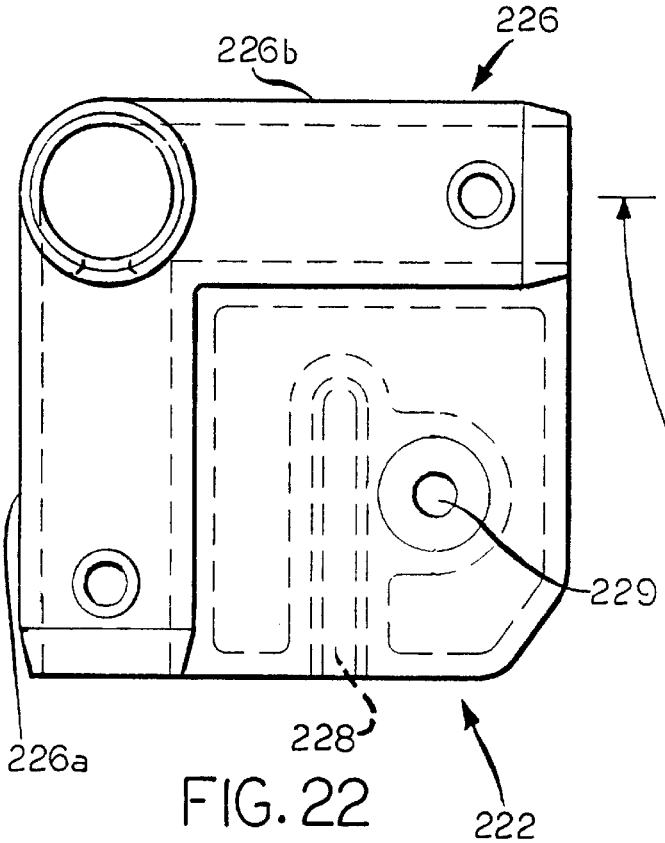
FIG. 22 shows a front view of the upper left corner bracket assembly according to the second preferred embodiment of FIG. 2.
Figure 23:
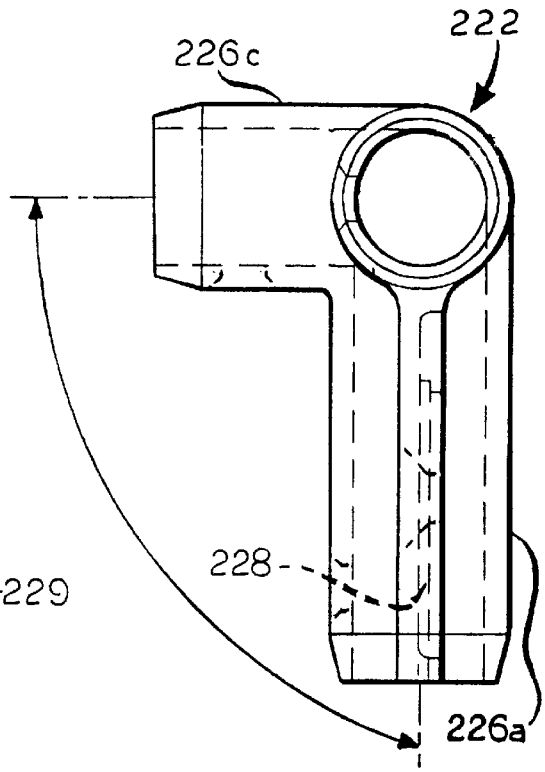
FIG. 23 shows a side view of the upper left corner bracket assembly of FIG. 22.
Figure 24:
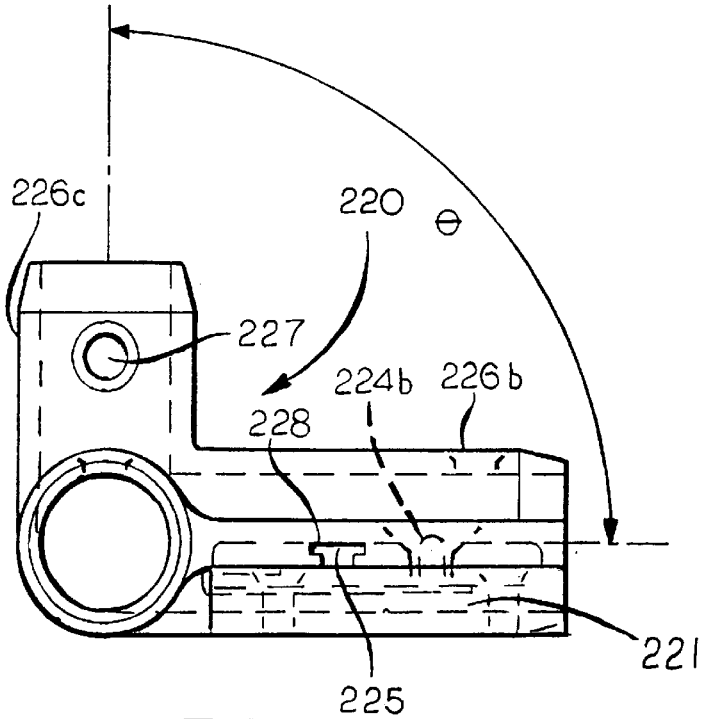
FIG. 24 shows a bottom view of the upper left corner bracket assembly of FIG. 22 when the support member is removably attached to the mounting plate.

FIGS. 22 through 24 show the upper left corner bracket assembly 220 according to the second preferred embodiment of the invention. The upper left corner bracket assembly 220 includes a mounting plate 221 and a support member 222. The features of the mounting plate 221 is substantially similar to the mounting plate 111 of the first preferred embodiment of the invention. Thus, the mounting plate 221 includes a plurality of openings (dotted lines) for attaching the mounting plate 221 to a structure, at least one projection 225 on the front surface and a snap button opening (dotted lines) for allowing snap button head 224*b* to project therethrough. For brevity, the discussion of these features will be omitted herein.

Referring now to FIG. 22, the support member 222 includes a plurality of female coupling parts 226, preferably 3 female coupling parts 226*a*, 226*b*, 226*c*, located on an upper portion of the support member 222.

Similar to the female coupling parts of the first embodiment, each coupling part 226 are tapered on the end for aesthetic purposes and have a substantially uniform inner diameter to form a port or opening for allowing arm bars 260 to slidingly enter the female coupling part 226. Also, each female coupling part 226 includes a snap button opening 227. Preferably, all three female coupling parts 226 are disposed at an angle of approximately 90 degrees with respect to the longitudinal axis passing through the center of each female coupling part 226. It should be noted that one female coupling part 226*c* is preferably disposed directly above another female coupling part 226*a* to form a substantially L-shaped upper portion of the support member 222.

As best seen in FIG. 23, at least one of the female coupling parts 226 may be at an angle, θ, with respect to the lower portion of the support member 222. It should be appreciated that the angle, θ, may be any angle, such as, 67.5, 45.0, 22.5 degrees and the like, to form any awning design. In addition, it should be appreciated that the second preferred embodiment of the invention is not limited to the number of female coupling parts 226 and that the invention can be practiced with any number of female coupling parts 226.

FIG. 24 shows the support member 222 that may be removably attached to the mounting plate 221 in a manner similar to the first preferred embodiment. This is accomplished by sliding the support member 222 onto the mounting plate 221 in a downward direction such that the projection 225 is received in the slot 228 until the snap button head 224*b* disposed within the mounting plate 221 is aligned with the snap button opening 229 on the support member 222. The spring force of the snap button causes the snap button head 224*b* to protrude from the snap button opening 229, thereby removably attaching the support member 222 to the mounting plate 221. Following the reverse procedure, the support member 222 may be easily removed from the mounting plate 221 by depressing the snap button head 224*b* protruding through the mounting plate 221 and sliding the support member 222 in an upward direction until the projection 225 no longer slidengly engages the slot 228.

It should be realized that the right upper corner bracket assembly 230 of the second preferred embodiment of the invention is identical to the upper left corner bracket assembly 220, but with mirror symmetry in the vertical direction. For brevity, the discussion relating to the upper right corner bracket assembly 230 is omitted herein.

Figure 25:
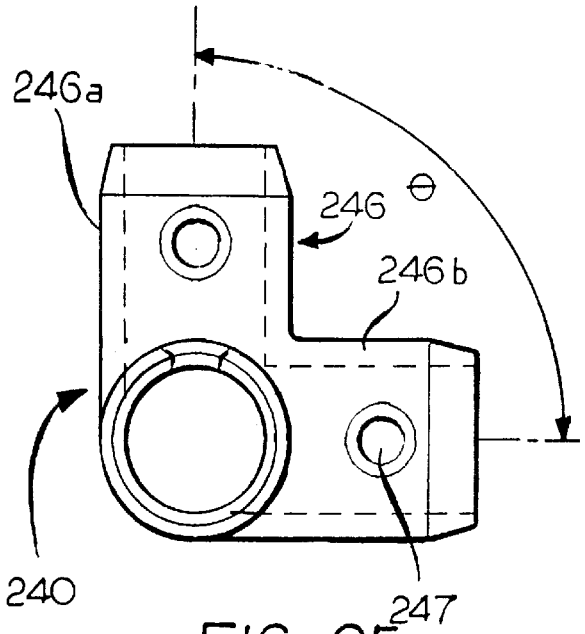
FIG. 25 shows a top view of the L-shaped, left 3-way corner fitting of the invention.
Figure 26:
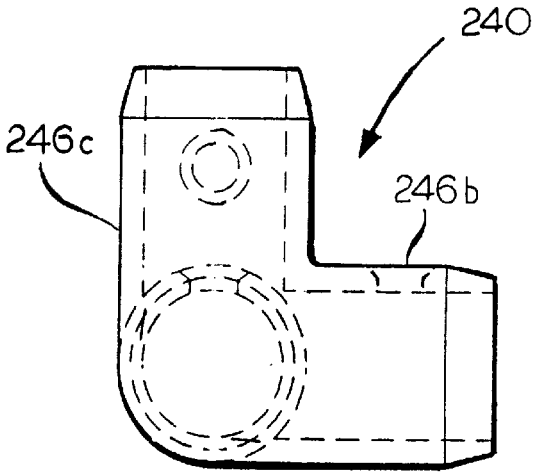
FIG. 26 shows a front view of the fitting of FIG. 25.
Figure 27:
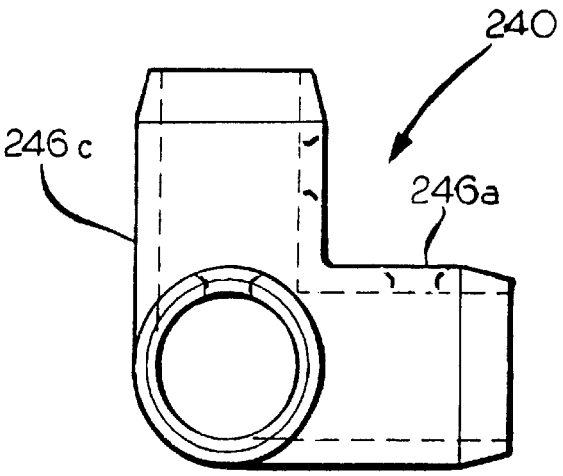
FIG. 27 shows a side view of the fitting of FIG. 25.

FIGS. 25 through 27 show a left 3-way corner fitting 240 according to the second preferred embodiment of the invention. The fitting 240 includes a plurality of female coupling parts 246, preferably 3 female coupling parts 246*a*, 246*b*, 246*c*, disposed at an angle of approximately 90 degrees with respect to the longitudinal axis passing through the center of the female coupling parts 246. Similar to other coupling parts, each female coupling part 246 are tapered on the end for aesthetic purposes and have a substantially uniform inner diameter to form a port or opening for allowing arm bars 260 to slidingly enter into the female coupling part 246. As best seen in FIG. 25, each female coupling part 246 includes a snap button opening 247 to allow the button head of the snap button of the arm bar 260 to protrude in a manner similar to the first preferred embodiment.

It should be noted that, unlike the T-shaped fitting 140 of the first preferred embodiment, one of the female coupling parts 246*a* is aligned directly above the other female two couplings parts to form a fitting 240 having a substantially L-shaped cross-sectional shape. It should be also appreciated that the invention is not limited to the number or the angle of the female coupling parts and that the invention can be practiced with any number of female coupling parts having any angle with respect to each other.

For example, two of the female coupling parts 246*a*, 246*b* may be at an angle, θ, with respect to an axis (dotted line) through the center of each female coupling part 246*a*, 246*b*. In the preferred embodiment, the angle, θ, is approximately 90 degrees. However, the angle, θ, may be any angle, such as 22.5, 45, 67.5 degrees, with respect to each other, depending on the frame system design.

It should be readily apparent that the right 3-way corner fitting 250 of the second preferred embodiment of the invention is identical to the left 3-way corner fitting 240, but with mirror symmetry in the vertical direction. For brevity, the discussion relating to the right 3-way corner fitting 250 is omitted herein.

Referring now to FIG. 2, the awning frame system 200 includes a plurality of arm bars 260. The operation of the arm bars 260 of the second preferred embodiment are substantially identical to the operation of the arm bars 160 of the first preferred embodiment of the invention. Thus, each arm bar 260 may be removably attached to a female coupling part by depressing the button head while slidably entering the arm bar 260 into the female coupling part until the button head is substantially aligned with the snap button opening. Once substantially aligned, the button head projects from the female coupling part due to the spring force of the snap button, thereby removably attaching the arm bar 260 to the female coupling part. In this manner, the arm bars 260 can be easily snapped into place without the use of tools.

It should be readily apparent that the length and curvature of the arm bars 260 forming the convex-shaped awning frame system 200 are different than the arm bars 160 of the first preferred embodiment. As seen in FIG. 2, the awning frame system 200 preferably includes a pair of straight top arm bars, a pair of straight wall arm bars, a pair of straight side arm bars, a pair of straight front arms bars, and three (3) convex arcuate arm bars. It should also be readily apparent that the width of the frame system 200 may be made to any width by providing additional center awning bracket assemblies 210, T-shaped fittings 140 and convex, arcuate arm bars 260 in order to properly support the awning frame system 200.

Figure 3:
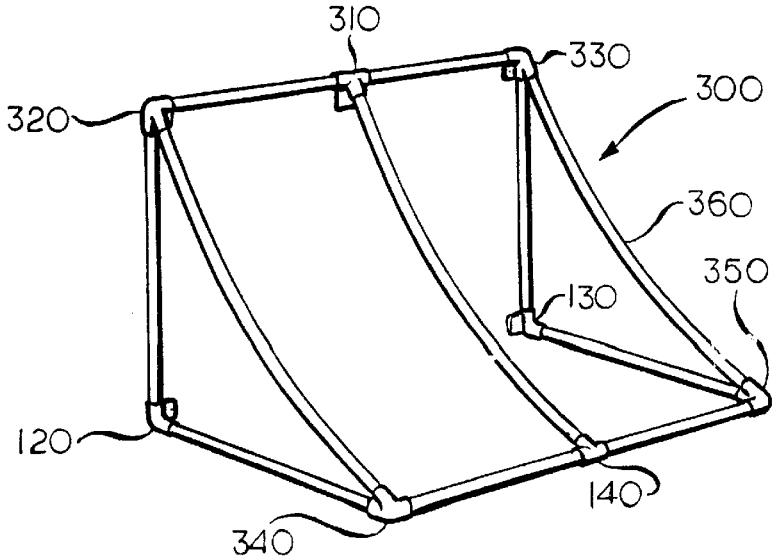
FIG. 3 shows a side perspective view of a concave awning design using the prefabricated collapsible awning frame system according to a third preferred embodiment of the invention.

FIG. 3 shows a concave awning design of the prefabricated collapsible awning frame system 300 according to a third preferred embodiment of the invention. In general, the awning frame system 300 includes a center bracket assembly 310, an upper left corner bracket assembly 320, an upper right corner bracket assembly 330, a lower left corner bracket assembly 120, a lower right corner bracket assembly 130, at least one T-shaped fitting 140, a left 3-way corner fitting 340, a right 3-way corner fitting 350, and a plurality of arm bars 360. Similar to the awning frame system 100, the awning frame system 300 may be made of any suitable material, preferably a lightweight, sturdy material, such as polyvinyl chloride (PVC), acrylonitrile butadiene styrene (ABS), Nylon (polyamide), steel, stainless steel, aluminum and the like. It should be noted that the center bracket assembly 310 may not be necessary if the width of the awning frame system 300 can be supported solely by the left and right corner bracket assemblies. For example, with an awning frame system of only 24 inches, it may not be necessary to have a center bracket assembly, whereas an awning frame system of 48 inches in width may require a center bracket assembly.

It should be readily apparent that the center bracket assembly 310 of the third preferred embodiment is substantially identical to the center bracket assembly 210 of the second preferred embodiment shown FIGS. 19 through 21, except that the longitudinal axis passing through the center of one of the female coupling parts is preferably at an angle of approximately 22.5 degrees, rather than approximately 90 degrees with respect to the lower portion of the support member 322. For brevity, the discussion of the center bracket assembly 310 will be omitted herein.

Figure 28:
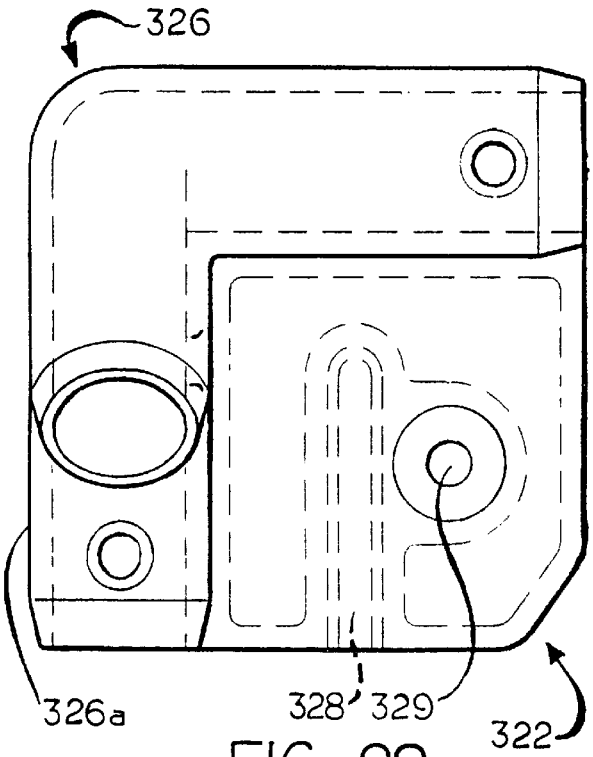
FIG. 28 shows a front view of the upper left corner bracket assembly according to the third preferred embodiment of FIG. 3.
Figure 29:
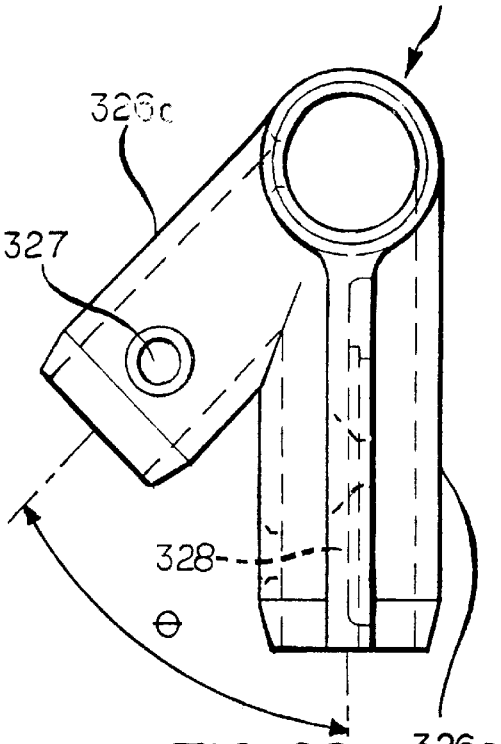
FIG. 29 shows a side view of the upper left corner bracket assembly of FIG. 28.
Figure 30:
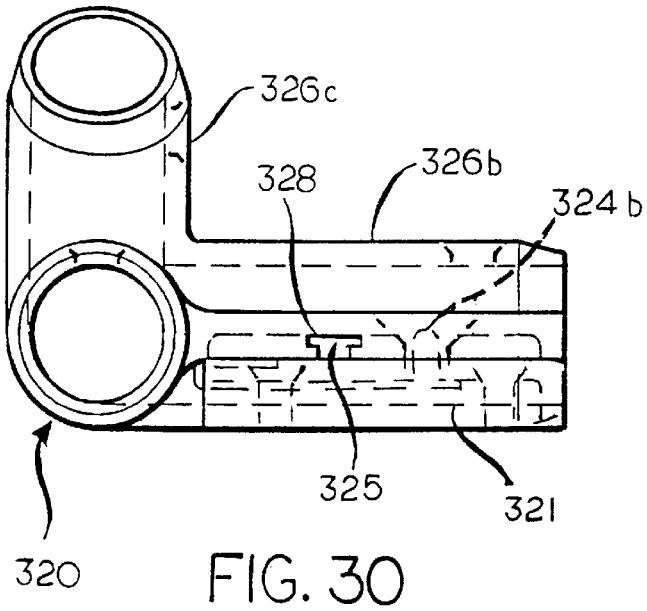
FIG. 30 shows a bottom view of the upper left corner bracket assembly of FIG. 28 when the support member is removably attached to the mounting plate.

FIGS. 28 through 30 show the upper left corner bracket assembly 320 according to the third preferred embodiment of the invention. Similar to the bracket assemblies of the previous embodiments, the upper left corner bracket assembly 320 includes a mounting plate 321 and a support member 322. The mounting plate 321 is substantially similar to the mounting plate 221 of the second preferred embodiment of the invention. Thus, the mounting plate 321 includes a plurality of openings (dotted lines) for attaching the mounting plate 321 to a structure, at least one projection 325 on the front surface and a snap button opening (not shown) for allowing the button head of the snap button head 324*b* to project therethrough.

The support member 322 includes a plurality of female coupling parts 326, preferably 3 female coupling parts 326*a*, 326*b*, 326*c*, located on an upper portion of the support member 322. Similar to the female coupling parts of the previous embodiments, each coupling part 326 are tapered on the end for aesthetic purposes and have a substantially uniform inner diameter to form a port or opening for allowing arm bars 360 to slidingly enter the female coupling part 326. Also, each female coupling part 326 includes a snap button opening 327 for allowing the button head of the snap button disposed in each arm bar 360 to project therethrough.

It should be readily apparent that the upper left 3-way corner bracket assembly 320 of the third preferred embodiment is substantially identical to the upper left 3-way corner bracket assembly 220 of the second preferred embodiment, except the longitudinal axis passing through the center of one of the female coupling parts is preferably at an angle, θ, of approximately 22.5 degrees, rather than at an angle of approximately 90 degrees with respect to the lower portion of the support member 322.

FIG. 30 shows the support member 322 that may be removably attached to the mounting plate 321 in a manner similar to the previous embodiments. This is accomplished by sliding the support member 322 onto the mounting plate 321 in a downward direction such that the projection 325 is received in the slot 328 until the snap button head 324*b* of the snap button disposed within the mounting plate 321 is aligned with the snap button opening 329 on the support member 322. The spring force of the snap button causes the snap button head 324*b* to protrude from the snap button opening 329, thereby removably attaching the support member 322 to the mounting plate 321. Following the reverse procedure, the support member 322 may be easily removed from the mounting plate 321 by depressing the snap button head 324*b* of the snap button disposed in the mounting plate 321 while sliding the support member 322 in an upward direction until the projection 325 no longer engages the slot 328.

It should be realized that the right upper corner bracket assembly 330 of the third preferred embodiment of the invention is identical to the upper left corner bracket assembly 320, but with mirror symmetry in the vertical direction. For brevity, the discussion relating to the upper right corner bracket assembly 330 is omitted herein.

Figure 31:
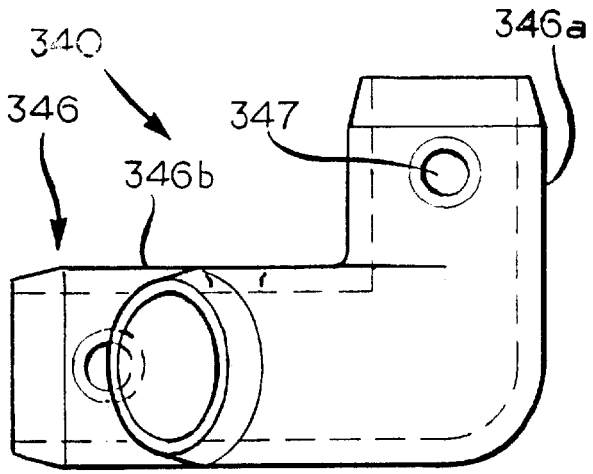
FIG. 31 shows a top view of the left 3-way corner fitting of the invention.
Figure 32:
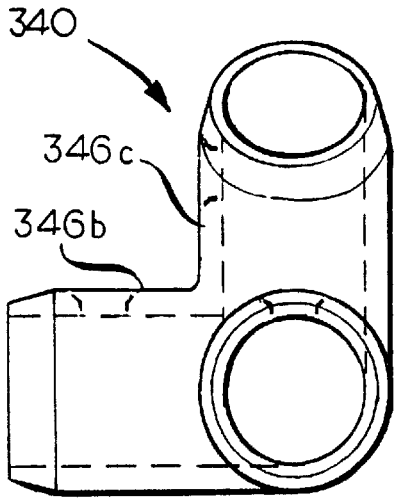
FIG. 32 shows a front view of the fitting of FIG. 31.
Figure 33:
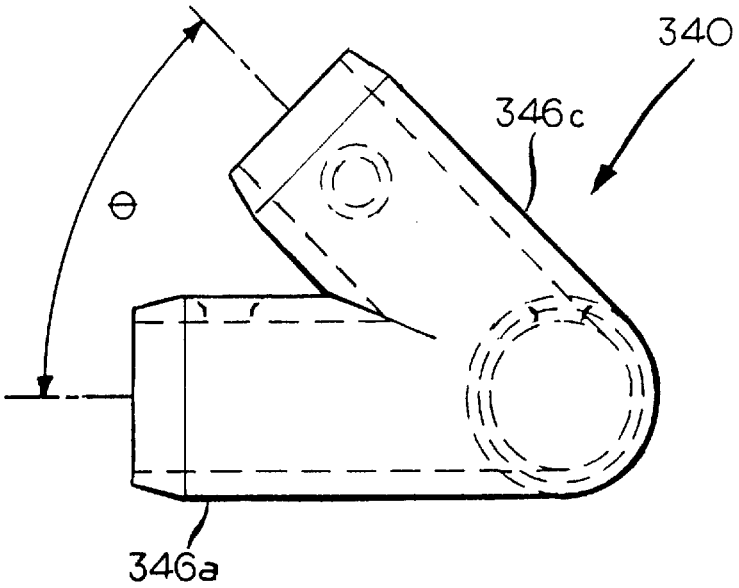
FIG. 33 shows a side view of the fitting of FIG. 31.

FIGS. 31 through 33 show a left 3-way corner fitting 340 according to the third preferred embodiment of the invention. The fitting 340 includes a plurality of female coupling parts 346, preferably 3 female coupling parts 346*a*, 346*b*, 346*c*. The longitudinal axis passing through the center of each female coupling part 346 is preferably disposed at an angle of approximately ninety 90 degrees with respect to each other. Similar to the coupling parts of the previous embodiments, each female coupling part 346 are tapered on the end for aesthetic purposes and have a substantially uniform inner diameter to form a port or opening for allowing arm bars 360 to slidingly enter the female coupling part 346. As best seen in FIG. 31, each female coupling part 346 includes a snap button opening 347 to allow the button head of the snap button disposed in the arm bar 360 to protrude therethrough in a manner similar to the previous embodiments.

It should be readily apparent that the left 3-way corner fitting 340 of the third preferred embodiment is substantially identical to the left 3-way corner fitting 240 of the second preferred embodiment, except the longitudinal axis passing through the center of one of the female coupling parts 346*c*, for example, extends upwardly at an angle, θ, of approximately 22.5 degrees with respect the other two female coupling parts 346*a*, 346*b*. However, the invention is not limited by the angle of one of the female coupling parts, and that the angle may be any angle, such as 90.0, 67.5, 45.0 degrees, with respect to the other female coupling parts.

It should be also readily apparent that the right 3-way corner fitting 350 of the third preferred embodiment of the invention is identical to the left 3-way corner fitting 340, but with mirror symmetry in the vertical direction. For brevity, the discussion relating to the right 3-way corner fitting 350 is omitted herein.

Referring now to FIG. 3, the awning frame system 300 includes a plurality of arm bars 360. The operation of the arm bars 360 of the third preferred embodiment is substantially identical to the operation of the arm bars 160, 260 of the previous preferred embodiments of the invention. Thus, each arm bar 360 may be removably attached to a female coupling part by depressing the button head while slidingly entering the arm bar 360 into the female coupling part until the button head is substantially aligned with the snap button opening. Once aligned, the button head projects through the button head opening of the female coupling part due to the spring force of the snap button, thereby removably attaching the arm bar 360 to the female coupling part without the use of tools.

It should be readily apparent that the length and curvature of the arm bars 360 forming the concave-shaped awning frame system 300 are substantially identical to the arm bars 260 of the second preferred embodiment. That is, the awning frame system 300 preferably includes a pair of straight top arm bars, a pair of straight wall arm bars, a pair of straight side arm bars, a pair of straight front arms bars, and three concave arcuate arm bars, rather than three convex arcuate arm bars of the frame system 200 of the second preferred embodiment. It should also be readily apparent that the width of the frame system 300 may be made to any width by providing additional center awning bracket assemblies 310, T-shaped fittings 140 and concave, arcuate arm bars 360 in order to properly support the awning frame system 300.

It should be noted that the curvature of the arm bars and the angle of the female coupling parts on the corner bracket assemblies and corner fittings may be changed to 45 degrees, for example, to form a square awning frame design, rather than a concave or convex awning frame design.

FIG. 4 shows an inside mitered corner awning design of the prefabricated collapsible awning frame system 400 according to a fourth preferred embodiment of the invention. In general, the awning frame system 400 includes an inside mitered center bracket assembly 410, an upper left corner bracket assembly 320, an upper right corner bracket assembly 330, a lower left corner bracket assembly 120, a lower right corner bracket assembly 130, an inside mitered center fitting 460, a left 3-way corner fitting 340, a right 3-way corner fitting 350, and a plurality of arm bars 470. Similar to the awning frame system 100, the awning frame system 400 may be made of any suitable material, preferably a lightweight, sturdy material, such as polyvinyl chloride (PVC), acrylonitrile butadiene styrene (ABS), Nylon (polyamide), steel, stainless steel, aluminum and the like.

Referring now to FIGS. 34 through 36, the inside mitered center bracket assembly 410 includes a pair of mounting plates 411 and a support member 412. The features and operation of the mounting plates 411 are substantially similar to the mounting plate 111 of the first preferred embodiment of the invention. Thus, the mounting plates 411 include a plurality of openings (dotted lines) for attaching the mounting plates 411 to a structure, a pair of projections 425 on the front surface and snap button openings (not shown) for allowing a snap button head 424*b* of a snap button to project therethrough. For brevity, the discussion of these features will be omitted herein.

The support member 412 includes a plurality of female coupling parts 416, preferably 3 coupling parts 416*a*, 416*b*, 416*c*, located at an upper portion of the support member 412. It should be appreciated that the invention is not limited to the number of female coupling parts 416 and that the invention can be practiced with any number of female coupling parts.

Similar to the female coupling parts of the previous embodiments of the invention, each female coupling part 416 are tapered on the end for aesthetic purposes and have a substantially uniform inner diameter to form a port or opening for allowing the arm bars 470 to slidingly enter each female coupling part 416. Also, a snap button opening 417 is located on the end of each female coupling part 416.

As best seen in FIG. 36, two of the female coupling parts 416*a*, 416*b* are disposed at an angle of approximately 90 degrees with respect to a longitudinal axis passing through the center of the female coupling parts 416*a*, 416*b*. The third female coupling part 416*c* is located directly above the other two female coupling parts 416*a*, 416*b* to form a generally L-shaped upper portion of the support member 412.

As best seen in FIG. 34, the longitudinal axis passing through the center of the third coupling part 416*c* is at an angle, θ, with respect to the lower portion of the support member 412, preferably at an angle of approximately 45 degrees. It should be appreciated that the angle, θ, may be any angle, such as 90, 67.5, 22.5 degrees and the like, to form any desired awning design.

FIG. 36 shows the support member 412 that may be removably attached to the mounting plates 411 in a similar manner as the previous embodiments by sliding the support member 412 onto the mounting plates 411 such that the projections 425 are received in the slot 428. The support member 412 is slidingly received until the snap button heads 424*b* that are disposed within the mounting plates 411 align with the snap button opening 419 of the support member 412. The spring force of the snap buttons cause the snap button heads 424*b* to protrude from the snap button openings 419, thereby removably attaching the support member 412 to the mounting plates 411. The support member 412 may be removed using the reverse procedure.

Figure 37:
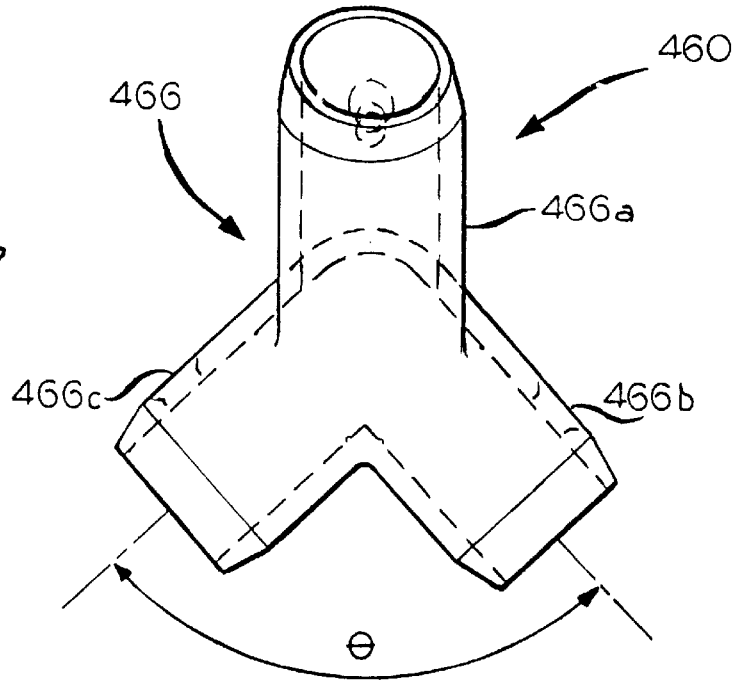
FIG. 37 shows a top view of the inside mitered corner 3-way fitting of the invention.
Figure 38:
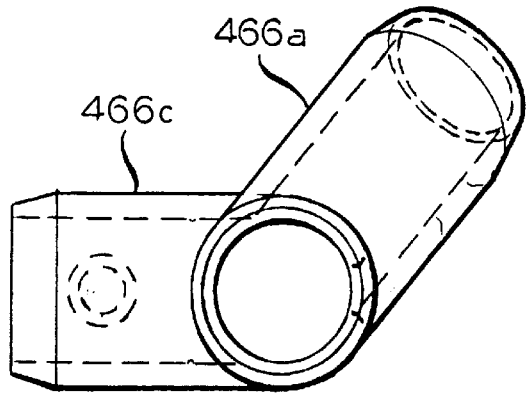
FIG. 38 shows a side view of the fitting of FIG. 37.
Figure 39:
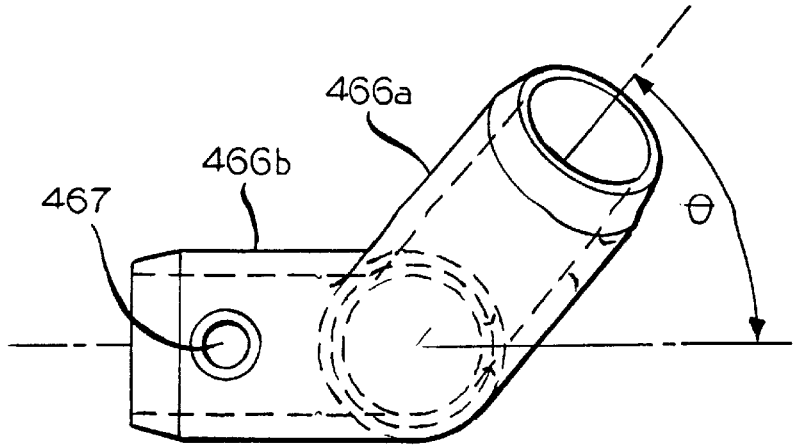
FIG. 39 shows another side view of the fitting of FIG. 37.

FIGS. 37 through 39 show an inside mitered center 3-way fitting 460 according to the fourth preferred embodiment of the invention. The fitting 460 includes a plurality of female coupling parts 466, preferably 3 female coupling parts 466*a*, 466*b*, 466*c*. Similar to the female coupling parts of the previous embodiments of the invention, each female coupling part 466 are tapered on the end for aesthetic purposes and have a substantially uniform inner diameter to form a port or opening for allowing arm bars 470 to slidingly enter each female coupling part 466. As best seen in FIG. 39, each female coupling part 466 includes a snap button opening 467 to allow the button head of the snap button of the arm bar 470 to protrude therethrough in a manner similar to the previous embodiments.

As best seen in FIG. 37, the longitudinal axis passing through the center of the female coupling parts 466*b*, 466*c* are at an angle, θ, of approximately 90 degrees with respect to each other. In addition, as best seen in FIG. 39, the longitudinal axis passing through the center of female coupling part 466*a* is at an upward angle, θ, of approximately 45 degrees with respect to a longitudinal axis passing through the center of female coupling parts 466*b*, 466*c*.

It should be also appreciated that the fourth preferred embodiment of the invention is not limited to the number or the angle of the female coupling parts and that the invention can be practiced with any number of female coupling parts having any angle with respect to each other.

Referring now to FIG. 4, the awning frame system 400 includes a plurality of arm bars 470. The operation and features of the arm bars 470 of the fourth preferred embodiment of the invention are substantially identical to the arm bars of the previous preferred embodiments of the invention. Thus, each arm bar 470 may be removably attached to a female coupling part by depressing the button head while slidably entering the arm bar 470 into the female coupling part until the button head is substantially aligned with the snap button opening. Once aligned, the button head projects through the button head opening of the female coupling part due to the spring force of the snap button, thereby removably attaching the arm bar 470 to the female coupling part without the use of tools.

The arm bars 470 forming the inside mitered corner awning frame system 400 includes a pair of straight top arm bars, a pair of straight wall arm bars, a pair of straight side arm bars, a pair of straight front arms bars, and three straight, downwardly angled arm bars. It should be readily apparent that the width of the frame system 400 may be made to any width by providing additional center awning bracket assemblies 310, T-shaped fittings 140 and straight, downwardly angled arm bars in order to properly support the awning frame system 400.

FIG. 5 shows an outside mitered corner awning design of the prefabricated collapsible awning frame system 500 according to a fifth preferred embodiment of the invention. In general, the awning frame system 500 includes an outside mitered center bracket assembly 510, an upper left corner bracket assembly 320, an upper right corner bracket assembly 330, a lower left corner bracket assembly 120, a lower right corner bracket assembly 130, an outside mitered center fitting 560, a left 3-way corner fitting 340, a right 3-way corner fitting 350, and a plurality of arm bars 570. Similar to the awning frame system 100, the awning frame system 500 may be made of any suitable material, preferably a lightweight, sturdy material, such as polyvinyl chloride (PVC), acrylonitrile butadiene styrene (ABS), Nylon (polyamide), steel, stainless steel, aluminum and the like.

Figure 41:
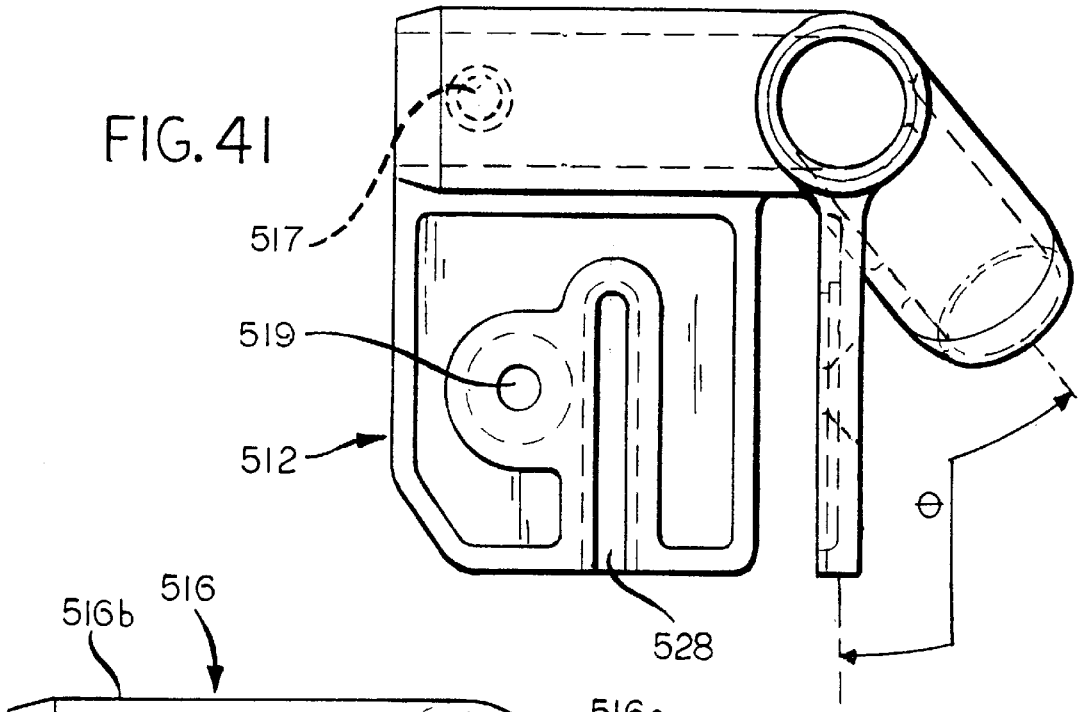
FIG. 41 shows a back view of the center outside mitered corner bracket assembly of FIG. 40.
Figure 40:
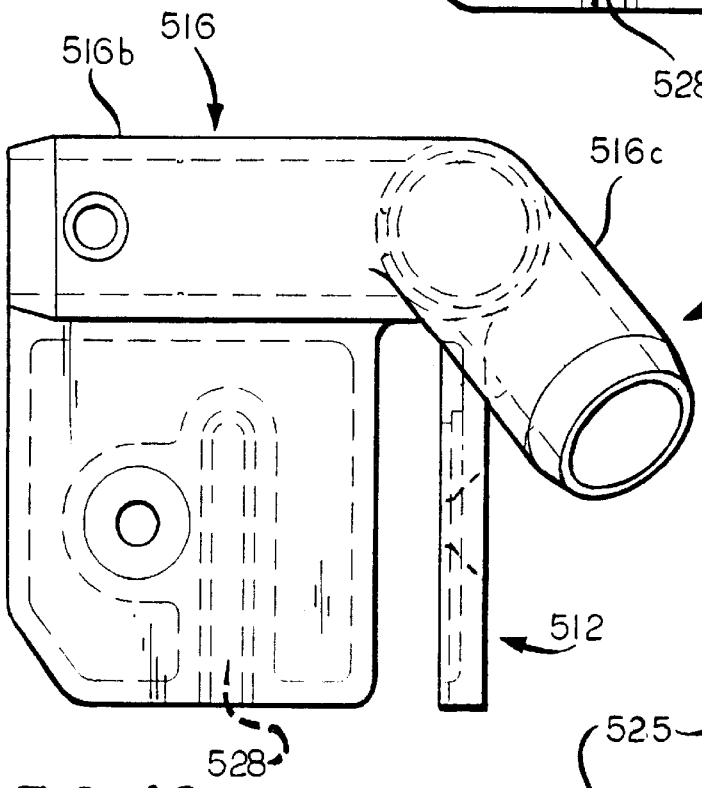
FIG. 40 shows a front view of the center outside mitered corner bracket assembly according to the fourth preferred embodiment of FIG. 5.
Figure 42:
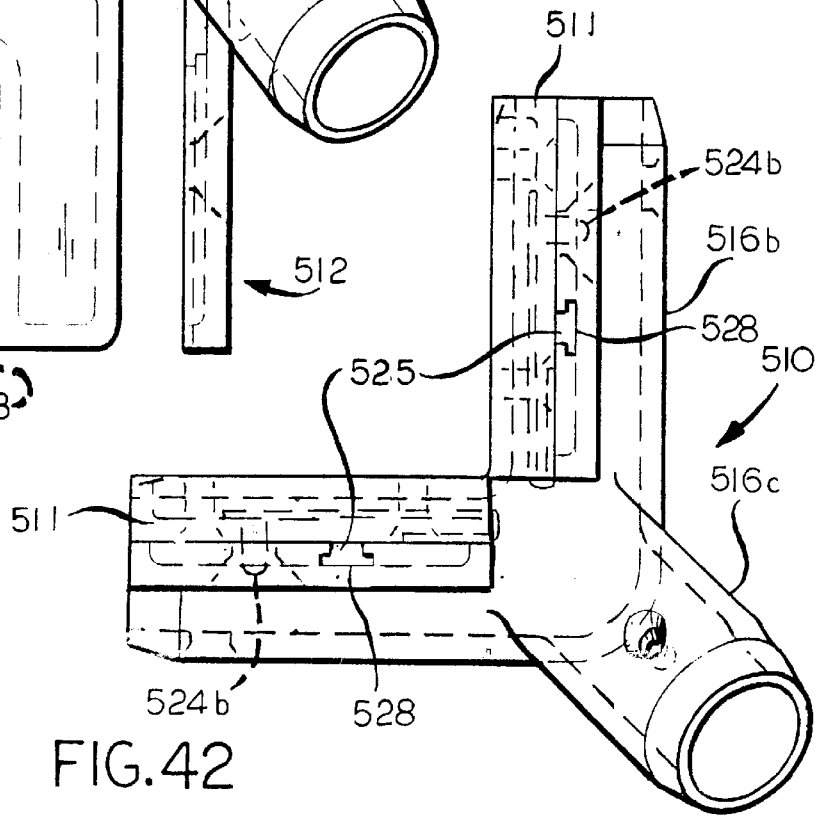
FIG. 42 shows a bottom view of the center outside mitered corner bracket assembly of FIG. 40 when the support member is removably attached to the mounting plate.

Referring now to FIGS. 40 through 42, the outside mitered center bracket assembly 510 includes pair of mounting plates 511 and a support member 512. The operation and features of the mounting plates 511 are substantially similar to the mounting plates 411 of the fourth preferred embodiment of the invention. Thus, the mounting plates 511 includes a plurality of openings (dotted lines) for attaching the mounting plates 511 to a structure, a pair of projections 525 on the front surface and snap button openings (not shown) for allowing a snap button heads 524*b* to project therethrough. For brevity, the discussion of these features will be omitted herein.

The support member 512 includes a plurality of female coupling parts 516, preferably 3 female coupling parts 516*a*, 516*b*, 516*c*, located on an upper portion of the support member 512. It should be appreciated that the fifth embodiment of the invention is not limited to the number of female coupling parts 516 and that the invention can be practiced with any number of female coupling parts. Similar to the female coupling parts of the previous embodiments of the invention, each female coupling part 516 is tapered on the end for aesthetic purposes and have a substantially uniform inner diameter to form a port or opening for allowing the arm bars 570 to slidingly enter each female coupling part 516. Also, a snap button opening 517 is located at the end of each female coupling part 516 for receiving the button head of the snap button disposed in the arm bars 570.

As best seen in FIG. 42, the longitudinal axis passing through the center of two of the female coupling parts 516*a*, 516*b* are disposed at an angle of approximately 90 degrees with respect to each other. The longitudinal axis passing through the center of the third female coupling part 516*c* is located at the end of the other two female coupling parts 516*a*, 516*b* to form a generally L-shaped upper portion of the support member 512.

As best seen in FIG. 42, the longitudinal axis passing through the center of the third coupling part 516*c* is at a downward angle, θ, preferably at an angle of approximately 45 degrees, with respect to the lower portion of the support member 512. It should be appreciated that the angle, θ, may be any angle, such as 90, 67.5, 22.5 degrees and the like, to form any desired awning design.

FIG. 42 shows the support member 512 that may be removably attached to the mounting plates 511 similar to the previous embodiments of the invention. This is accomplished by sliding the support member 512 onto the mounting plates 511 such that the projections 525 are received in the slots 528. The support member 512 is slidingly received in the slots 528 until the snap button heads 524*b* of the snap buttons that are disposed within the mounting plates 511 align with the snap button openings 519 of the support member 512. The spring force of the snap buttons causes the snap button heads 524*b* to protrude through the snap button openings 519, thereby removably attaching the support member 512 to the mounting plates 511.

Figure 43:
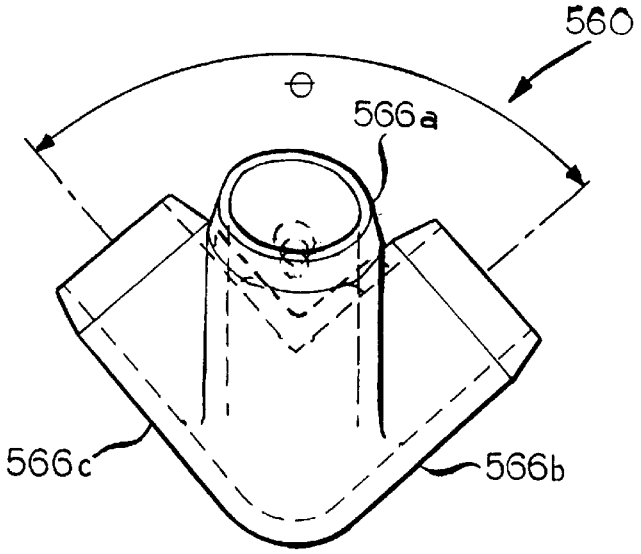
FIG. 43 shows a top view of the outside mitered corner 3-way fitting of the invention.
Figure 44:
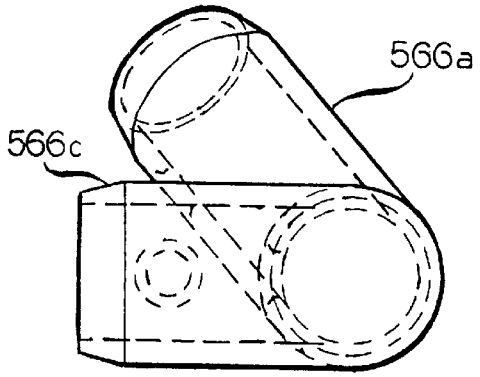
FIG. 44 shows a side view of the fitting of FIG. 37.
Figure 45:
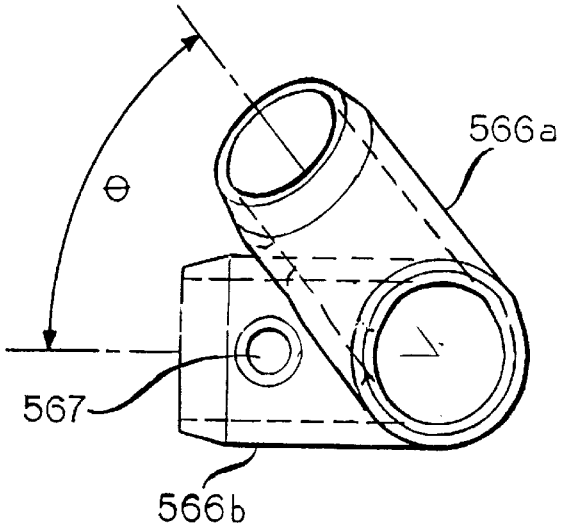
FIG. 45 shows another side view of the fitting of FIG. 37.

FIGS. 43 through 45 show the outside mitered center 3-way fitting 560 according to the fifth preferred embodiment of the invention. The fitting 560 includes a plurality of female coupling parts 566, preferably 3 female coupling parts 566*a*, 566*b*, 566*c*. Similar to the female coupling parts of the previous embodiments of the invention, each female coupling part 566 are tapered on the end for aesthetic purposes and have a substantially uniform inner diameter to form a port or opening for allowing arm bars 570 to slidingly enter the female coupling part 566. As best seen in FIG. 45, each female coupling part 566 includes a snap button opening 567 to allow the button head of the snap button (dotted lines) of the arm bar 570 to protrude therethrough.

As best seen in FIG. 43, the longitudinal axis passing through the center of two of the female coupling parts 566*b*, 566*c* are at an angle, θ, of approximately 90 degrees with respect to each other. In addition, as best seen in FIG. 45, a longitudinal axis passing through the center of female coupling part 566*a* is at an upward angle, θ, of approximately 45 degrees with respect to a longitudinal axis passing through the center of female coupling parts 566*b*, 566*c*.

It should be appreciated that the invention is not limited to the number or the angle of the female coupling parts and that the invention can be practiced with any number of female coupling parts having any angle with respect to each other.

Referring now to FIG. 5, the awning frame system 500 includes a plurality of arm bars 570. The operation and features of the arm bars 570 of the fifth preferred embodiment of the invention are substantially identical to the arm bars of the previous preferred embodiments of the invention. Thus, each arm bar 570 may be removably attached to a female coupling part by depressing the button head while slidably entering the arm bar 570 into the female coupling part until the button head of the snap button disposed in the arm bar 570 is substantially aligned with the snap button opening of the female coupling part. Once aligned, the button head projects through the snap button opening of the female coupling part due to the spring force of the snap button, thereby removably attaching the arm bar 570 to the female coupling part without the use of tools.

Similar to the awning frame system 400, the arm bars 570 forming the awning frame system 500 includes a pair of straight top arm bars, a pair of straight wall arm bars, a pair of straight side arm bars, a pair of straight front arm bars, and three straight, downwardly angled arm bars. It should be readily apparent that the width of the frame system 500 may be made to any width by providing additional center awning bracket assemblies 310, T-shaped fittings 140 and straight, downwardly angled arm bars to sufficiently support the awning frame system 500.

FIG. 6 shows a circle awning design of the prefabricated collapsible awning frame system 600 according to a sixth preferred embodiment of the invention. In general, the awning frame system 600 includes a left corner bracket assembly 120, a right corner bracket assembly 130, a pair of 2-way corner fittings 610 and a plurality of arm bars 660. Similar to the previous awning frame systems, the awning frame system 600 may be made of any suitable material, preferably a lightweight, sturdy material, such as polyvinyl chloride (PVC), acrylonitrile butadiene styrene (ABS), Nylon (polyamide), steel, stainless steel, aluminum and the like.

Figure 47:
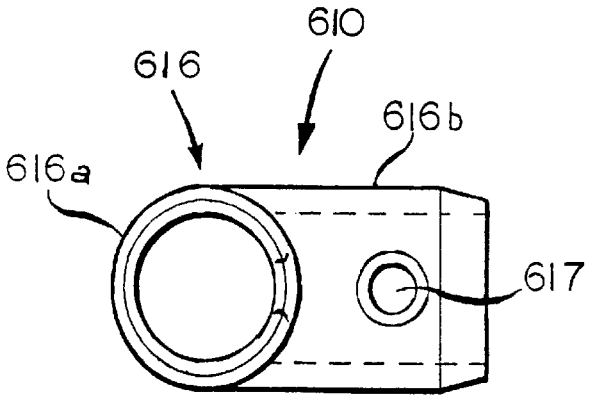
FIG. 47 shows a side view of the fitting of FIG. 46.
Figure 46:
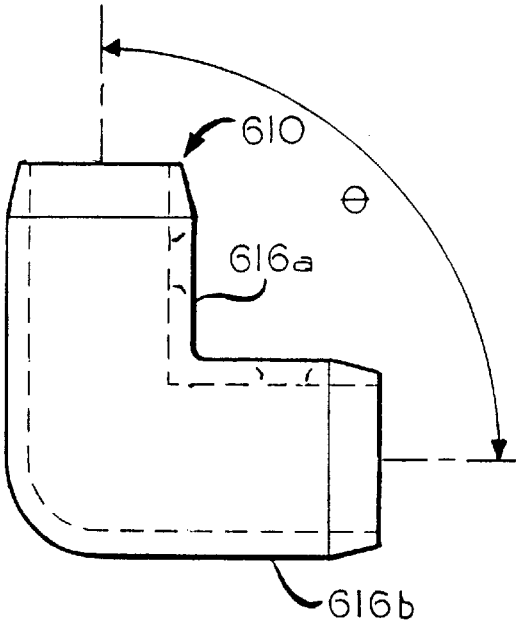
FIG. 46 shows a top view of the 2-way corner fitting of the invention.
Figure 48:
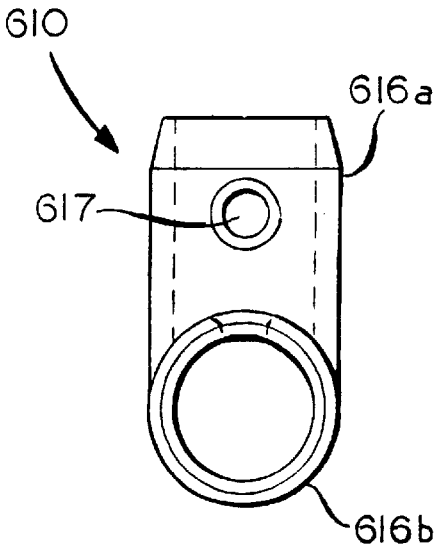
FIG. 48 shows another side view of the fitting of FIG. 46.

FIGS. 46 through 48 shows the 2-way corner fitting 610 according to the sixth preferred embodiment of the invention. The fitting 610 includes a plurality of female coupling parts 616, preferably 2 female coupling parts 616*a*, 616*b*. Similar to the female coupling parts of the previous embodiments of the invention, each female coupling part 616 are tapered on the end for aesthetic purposes and have a substantially uniform inner diameter to form a port or opening for allowing arm bars 660 to slidingly enter into the female coupling part 616. As best seen in FIG. 47, each female coupling part 616 includes a snap button opening 617 to allow the button head of the snap button disposed in the arm bar 660 to protrude therethrough.

As best seen in FIG. 46, the female coupling parts 616*a*, 616*b* are preferably disposed at an angle, θ, of approximately 90 degrees with respect to each other.

It should be also appreciated that the invention is not limited to the number or the angle of the female coupling parts 616 and that the invention can be practiced with any number of female coupling parts having any angle with respect to each other.

Referring now to FIG. 6, the awning frame system 600 includes a plurality of arm bars 670. The operation and features of the arm bars 670 of the sixth preferred embodiment of the invention are substantially identical to the arm bars of the previous preferred embodiments. Thus, each arm bar 670 may be removably attached to a female coupling part by depressing the button head while slidably entering the arm bar 670 into the female coupling part until the button head is substantially aligned with the snap button opening. Once aligned, the button head projects through the button head opening of the female coupling part due to the spring force of the snap button, thereby removably attaching the arm bar 670 to the female coupling part without the use of tools. The arm bars 670 may be easily removed using a reverse procedure.

The arm bars 670 forming the awning frame system 600 includes a pair of straight side arm bars, a straight front arm bar, and an arcuate back arm bar. It should be readily apparent that the width of the frame system 600 may be made to any width by providing additional center awning bracket assemblies 310, T-shaped fittings 140 and arcuate arm bars in order to properly support the awning frame system 600.

In summary, the separate component design of the awning frame system allows for easy assembly and installation. This can be achieved because the mounting plates are designed to be mounted separate to the permanent structure, apart from the support members, connectors and arm bars, thereby allowing the fully assembled awning frame system to be raised and securely locked in place. A sloped-head button head may be used to securely lock the frame system in place without the need for the user to depress the button heads on the mounting plates. The awning frame system can be easily removed from the permanent structure by simply depressing the snap buttons located on the support members and lifting the awning frame system from the mounting plates.

In addition, by varying the number and angle of the awning brackets, fittings and arm bars, the prefabricated collapsible awning frame system is capable of forming a wide variety of awning frame designs without changing the easy-assembly, snap-together concept of the invention. For example, the height of the awning frame system may be varied to accommodate overhangs and other traditional problem areas that have insufficient height for conventional awning frame systems. Further, the width of the awning frame system may be varied to accommodate patio doors, windows and standard entry doors. Further, other fastening means may be used instead of the snap buttons disposed within the mounting plate and arm bars to removably attach the support member to the mounting plate and the arm bar to the support member.

It should be realized that the arm bars may not necessarily have a continuous bend and that they may have a plurality of bends to form the awning design. For example, the arm bar may be connected to the support member at a 90 degree angle, extend downward after some distance from the support member at a 45 degree downward angle, then bend again at a 45 degree angle after some length to enter into the fitting at a 90 degree angle. Thus, the arm bar may have a plurality of sides of a polygon shaped object in order to form the desired awning frame design.

In all the preferred embodiments of the invention, the mounting plates and support members may be reinforced by the use of an insert, preferably made of metal or other suitably rigid material, for providing strength to the mounting plates and support members. Further, a cover may be easily attached to the frame system by sliding the arm bars through a slot or slit formed along the periphery or hem of the cover. In this manner, the cover may be easily removed to change the type of material, color and style to fit the particular needs of the consumer.

While this invention has been described in conjunction with specific embodiments, it is evident that many alternatives, modifications and variations will be apparent to those skilled in the art. Accordingly, the preferred embodiments of the invention as set forth herein are intended to be illustrative, rather than limiting. Various changes may be made without departing from the spirit and scope of the invention as defined in the following claims.

What is claimed is:

1. A prefabricated, collapsible awning frame system, comprising:

at least one bracket assembly, comprising:

a mounting plate for fixedly attaching to a physical structure, said mounting plate including at least one projection and a button head of a snap button projecting therefrom, the button head being offset from the at least one projection, and a support member removably attached to said mounting plate, said support member including at least one female coupling part defining an axial axis, said support member further including at least one slot being offset from the axial axis and at least one snap button opening being offset from the axial axis; and at least one arm bar removably attached to said support member, said at least one arm bar including at least one male coupling part with a button head of a snap button projecting therefrom, the at least one male coupling part being aligned with the axial axis, wherein said support member is removably attached to said mounting plate by sliding the slot of said support member onto the at least one projection of said mounting plate until the button head projecting from said mounting plate is substantially aligned with the button head opening of said support member, and wherein said at least one arm bar is removably attached to said support member by sliding the at least one male coupling part of said at least one arm bar into the at least one female coupling part of said support member until the button head projecting from said at least one arm bar is substantially aligned with the snap button opening of the female coupling part of said support member.

2. The awning frame system according to claim 1, wherein said at least one female coupling part of said support member has an angle of approximately 90 degrees with respect to a lower portion of said support member.

3. The awning frame system according to claim 1, wherein said at least one female coupling part has one of an upward and a downward angle with respect to a lower portion of said support member.

4. The awning frame system according to claim 1, further comprising a fitting having a plurality of female coupling parts, each coupling part having a snap button opening for receiving the snap button of the male coupling part of said at least one arm bar.

5. The awning frame system according to claim 4, wherein at least one of said plurality of female coupling parts is at an angle of approximately 90 degrees with respect to a longitudinal axis passing through a center of the other female coupling parts.

6. The awning frame system according to claim 5, wherein one of said plurality of female coupling parts has one of an upward and a downward angle with respect to the other female coupling parts.

7. The awning frame system according to claim 1, wherein said at least one bracket assembly comprises a center bracket assembly.

8. The awning frame system according to claim 1, wherein said at least one bracket assembly comprises an inside mitered center bracket assembly.

9. The awning frame system according to claim 1, wherein said at least one bracket assembly comprises an outside mitered center bracket assembly.

10. The awning frame system according to claim 1, wherein said at least one bracket assembly comprises a corner bracket assembly.

11. A prefabricated, collapsible awning frame system for attaching to a structure, comprising:

at least two corner bracket assemblies for supporting each side of said frame system, each corner bracket assembly including a support member having at least one female coupling part with a snap button opening, the at least one female coupling part defining an axial axis, said support member further including at least one receptacle slot being offset from the axial axis and at least one snap button opening being offset from the axial axis, and;

a center bracket assembly for supporting a center of said frame system, said center bracket assembly including a support member having at least one female coupling part with a snap button opening, the at least one female coupling part defining an axial axis, said support member further including at least one receptacle slot being offset from the axial axis and at least one snap button opening being offset from the axial axis;

a plurality of arm bars, each arm bar having at least one male coupling part with a snap button projecting therefrom, the at least one male coupling part being aligned with the axial axis; and a plurality of fitting members, each fitting member having at least one female coupling part with a snap button opening, wherein said awning frame system is assembled by inserting the at least one male coupling part into the at least one female coupling part until the snap button of the at least one male coupling part is received in the snap button opening of the at least one female coupling part.

12. The awning frame system according to claim 11, wherein at least one of said plurality of fitting members includes three female coupling parts.

13. The awning frame system according to claim 11, wherein said center bracket assembly includes a plurality of female coupling parts.

14. The awning frame system according to claim 11, wherein at least one corner bracket assembly includes two female coupling parts at an angle of approximately 90 degrees with respect to each other.

15. The awning frame system according to claim 11, wherein at least one corner bracket assembly includes three female coupling parts at an angle of approximately 90 degrees with respect to each other.

16. The awning frame system according to claim 11, wherein at least one corner bracket assembly includes two female coupling parts at an angle of approximately 90 degrees with respect to each other and a third female coupling part at an angle with respect to one of the other two female coupling parts.

17. The awning frame system according to claim 16, wherein the angle of said third female coupling part is approximately 45 degrees.

18. A prefabricated, collapsible awning frame system for attaching to a structure, comprising:

at least one corner bracket assembly on each side of said frame system, each corner bracket assembly including a support member having at least one female coupling part with a snap button opening, the at least one female coupling part defining an axial axis, said support member further including at least one slot being offset from the axial axis and at least one snap button opening being offset from the axial axis;

a mitered corner bracket assembly for supporting a center portion of said frame system, said mitered corner bracket assembly including a support member having at least one female coupling part with a snap button opening, the at least one female coupling part defining an axial axis, said support member further including at least one slot being offset from the axial axis and at least one snap button opening being offset from the axial axis;

a plurality of arm bars, each arm bar having at least one male coupling part with a snap button head projecting therefrom, the at least one male coupling part being aligned with the axial axis; and a plurality of fitting members, each fitting member having at least one female coupling part with a snap button opening, wherein said awning frame system is assembled by inserting the at least one male coupling part into the at least one female coupling part until the snap button of the at least one male coupling part is received in the snap button opening of the at least one female coupling part.

19. A method of forming an awning frame system, the method comprising the steps of:

(a) fixedly mounting a mounting plate to a structure, the mounting plate including a projection and a button head of a snap button projecting therefrom, the button head being offset from the projection;

(b) removably attaching a support member to said mounting, said support member including at least one female coupling part with a snap button opening, the at least one female coupling part defining an axial axis, said support member further including at least one slot being offset from the axial axis and at least one snap button opening being offset from the axial axis; and (c) removably attaching an arm bar to said support member, the arm bar including a male coupling part having a button head of a snap button projecting therefrom, the male coupling part being aligned with the axial axis, whereby said support member is removably attached to said mounting plate by slidably entering the slot of said support member onto the projection of said mounting plate until the button head of the snap button projecting from said mounting plate is substantially aligned with the button head opening of said support member, and whereby said arm bar is removably attached to said support member by slidingly entering said arm bar into said support member until the button head of the snap button projecting from said arm bar is substantially aligned with the snap button opening of said support member.

* * * * *